US010005596B2

(12) United States Patent
McBroom et al.

(10) Patent No.: US 10,005,596 B2
(45) Date of Patent: Jun. 26, 2018

(54) CONTAINER

(71) Applicant: ABBOTT LABORATORIES, Abbott Park, IL (US)

(72) Inventors: Jeremy McBroom, Columbus, OH (US); James Perry, Gahanna, OH (US)

(73) Assignee: ABBOTT LABORATORIES, Abbott Park, IL (US)

( * ) Notice: Subject to any disclaimer, the term of this patent is extended or adjusted under 35 U.S.C. 154(b) by 0 days. days.

(21) Appl. No.: 15/180,590

(22) Filed: Jun. 13, 2016

(65) Prior Publication Data

US 2016/0297575 A1 Oct. 13, 2016

Related U.S. Application Data

(62) Division of application No. 14/395,841, filed as application No. PCT/US2013/038468 on Apr. 26, 2013, now Pat. No. 9,387,963.

(Continued)

(51) Int. Cl.
*B65D 51/18* (2006.01)
*B65D 45/18* (2006.01)

(Continued)

(52) U.S. Cl.
CPC ..... *B65D 45/18* (2013.01); *B65D 43/163* (2013.01); *B65D 43/169* (2013.01); *B65D 43/22* (2013.01);

(Continued)

(58) Field of Classification Search
CPC ..... B65D 45/18; B65D 43/22; B65D 2251/1058; B65D 2543/00435; B65D 2543/00537; A01K 57/00

(Continued)

(56) References Cited

U.S. PATENT DOCUMENTS 711,452 A 10/1902 Meyer
2,648,097 A 8/1953 Kritchever (Continued)

FOREIGN PATENT DOCUMENTS

CN 1372061 A 10/2002
CN 1914096 2/2007

(Continued)

OTHER PUBLICATIONS

Office Action from Canadian Application No. 2,871,792 dated Apr. 3, 2017.

(Continued)

*Primary Examiner* — Shawn M Braden

(74) *Attorney, Agent, or Firm* — Calfee, Halter & Griswold LLP

(57) ABSTRACT

A container for holding granular or powdered material. The container includes walls, a collar, a lid and a latch. The walls define an interior space and an upper portion, the upper portion defining a sealing flange and an opening to the interior space. The collar is attached to the upper portion. The lid is attached to the collar for positioning between an open position and a closed position, and adapted to cover the opening while in the closed position. The latch is attached to an outer surface of the lid. The latch may have an actuator rotatable in two directions relative to the lid and detachably engaged to a catch which protrudes from an outside surface of the collar.

20 Claims, 24 Drawing Sheets

Related U.S. Application Data

(60) Provisional application No. 61/639,857, filed on Apr. 27, 2012.

(51) Int. Cl.

| | |
|---|---|
| ***B65D 43/16*** | (2006.01) |
| ***B65D 51/24*** | (2006.01) |
| ***B65D 43/22*** | (2006.01) |
| ***B65D 45/22*** | (2006.01) |
| ***B65D 53/02*** | (2006.01) |

(52) U.S. Cl.
CPC ..... *B65D 45/22* (2013.01); *B65D 51/247* (2013.01); *B65D 53/02* (2013.01); *B65D 2543/0099* (2013.01); *B65D 2543/00101* (2013.01); *B65D 2543/00296* (2013.01); *B65D 2543/00351* (2013.01); *B65D 2543/00435* (2013.01); *B65D 2543/00564* (2013.01); *B65D 2543/00842* (2013.01); *B65D 2543/00888* (2013.01)

(58) Field of Classification Search
USPC ..... 220/254.3
See application file for complete search history.

(56) References Cited

U.S. PATENT DOCUMENTS

| | | | | |
|---|---|---|---|---|
| 3,038,624 | A | 6/1962 | Wieckmann | |
| 3,187,920 | A | 6/1965 | Dorn | |
| 3,338,468 | A | 8/1967 | Wilson | |
| 3,613,964 | A | 10/1971 | Gronemeyer | |
| 3,966,082 | A | 10/1976 | Hopkins | |
| 4,000,816 | A | 1/1977 | Spruyt | |
| 4,089,433 | A | 5/1978 | Jonsson | |
| 4,095,716 | A | 6/1978 | Meany | |
| 4,293,079 | A | 10/1981 | Lytle | |
| 4,321,922 | A | 3/1982 | Deaton | |
| 4,408,698 | A | 10/1983 | Ballester | |
| 4,577,775 | A | 3/1986 | Kresin | |
| 4,727,999 | A | 3/1988 | Gach | |
| 4,736,870 | A | 4/1988 | Christensson | |
| 4,883,193 | A | 11/1989 | Christensson | |
| 4,917,261 | A | 4/1990 | Borst | |
| 4,971,220 | A | 11/1990 | Kaufman et al. | |
| 5,046,659 | A | 9/1991 | Warburton | |
| 5,050,763 | A | 9/1991 | Christensson | |
| 5,065,887 | A | 11/1991 | Schuh et al. | |
| 5,078,296 | A | 1/1992 | Amidzich | |
| 5,145,088 | A | 9/1992 | Goujon | |
| 5,193,759 | A | 3/1993 | Bigelow et al. | |
| 5,204,130 | A | 4/1993 | McDevitt et al. | |
| 5,219,087 | A | 6/1993 | Christensson | |
| D339,639 | S | 9/1993 | Ohnuma et al. | |
| 5,305,900 | A | 4/1994 | Maguire et al. | |
| 5,310,049 | A | 5/1994 | Bigelow et al. | |
| 5,322,178 | A | 6/1994 | Foos | |
| 5,337,911 | A | 8/1994 | Holub | |
| 5,353,946 | A | 10/1994 | Behrend | |
| 5,366,104 | A | 11/1994 | Armstrong | |
| 5,383,558 | A | 1/1995 | Wilkinson et al. | |
| 5,429,833 | A | 7/1995 | Wyslotsky | |
| 5,515,993 | A | 5/1996 | McManus | |
| 5,518,152 | A | 5/1996 | Burcham et al. | |
| 5,582,314 | A | 12/1996 | Quinn et al. | |
| 5,598,941 | A | 2/1997 | Semersky et al. | |
| 5,641,084 | A | 6/1997 | Rice | |
| 5,706,974 | A | 1/1998 | Murdick et al. | |
| 5,718,350 | A | 2/1998 | Williams | |
| 5,794,566 | A | 8/1998 | Goetz | |
| 5,810,188 | A | 9/1998 | Novakoski et al. | |
| 5,897,011 | A | 4/1999 | Brilliant et al. | |
| 5,897,036 | A | 4/1999 | DeCoster et al. | |
| 5,931,323 | A | 8/1999 | Wilkinson et al. | |
| 5,997,052 | A | 12/1999 | Reeb et al. | |
| 6,006,901 | A | 12/1999 | Pereira Da Silva | |
| 6,042,000 | A | 3/2000 | Kawamoto | |
| 6,238,762 | B1 | 5/2001 | Friedland et al. | |
| D444,027 | S | 6/2001 | Gilliam et al. | |
| 6,269,969 | B1 | 8/2001 | Huang | |
| 6,308,858 | B1 | 10/2001 | Koefelda | |
| 6,520,370 | B2 | 2/2003 | Nyman et al. | |
| D473,140 | S | 4/2003 | Gilliam et al. | |
| 6,609,633 | B1 | 8/2003 | Dyble et al. | |
| 6,644,494 | B2 | 11/2003 | Hayes et al. | |
| D484,797 | S | 1/2004 | Kipperman et al. | |
| 6,761,279 | B1 | 7/2004 | Martin et al. | |
| 6,761,283 | B1 | 7/2004 | Gilliam et al. | |
| 6,772,904 | B1 | 8/2004 | Gilliam et al. | |
| 6,789,692 | B2 | 9/2004 | Prezelin | |
| D504,318 | S | 4/2005 | Lane et al. | |
| 6,889,866 | B2 | 5/2005 | Gilliam et al. | |
| 6,964,359 | B1 | 11/2005 | Darr et al. | |
| 7,040,500 | B2 | 5/2006 | Kipperman et al. | |
| 7,080,754 | B2 * | 7/2006 | Lown | B65D 43/164 220/324 |
| D528,919 | S | 9/2006 | Kipperman et al. | |
| D530,616 | S | 10/2006 | Kipperman et al. | |
| D530,617 | S | 10/2006 | Little et al. | |
| 7,156,265 | B2 | 1/2007 | Walsh et al. | |
| 7,175,041 | B2 | 2/2007 | Ekkert | |
| 7,370,788 | B1 | 5/2008 | Otani et al. | |
| D576,035 | S | 9/2008 | Perry et al. | |
| D578,401 | S | 10/2008 | Perry et al. | |
| 7,621,417 | B2 | 11/2009 | Peterson et al. | |
| D640,544 | S | 6/2011 | Sifuentes et al. | |
| 8,308,008 | B2 | 11/2012 | Perry et al. | |
| D675,477 | S | 2/2013 | McGrath et al. | |
| 8,469,223 | B2 | 6/2013 | Perry et al. | |
| 8,511,499 | B2 | 8/2013 | Perry et al. | |
| 8,627,981 | B2 | 1/2014 | Perry et al. | |
| 8,857,645 | B2 | 10/2014 | Perry et al. | |
| D733,320 | S | 6/2015 | Perry et al. | |
| D751,215 | S | 3/2016 | Perry et al. | |
| 9,387,963 | B2 | 7/2016 | McBroom et al. | |
| 2001/0035424 | A1 | 11/2001 | Combe et al. | |
| 2002/0117504 | A1 | 8/2002 | Emerson et al. | |
| 2002/0190112 | A1 | 12/2002 | Culeron et al. | |
| 2003/0015542 | A1 | 1/2003 | Nulty et al. | |
| 2003/0072440 | A1 | 4/2003 | Murray et al. | |
| 2003/0121941 | A1 | 7/2003 | Walsh et al. | |
| 2003/0183540 | A1 | 10/2003 | Onishi | |
| 2003/0218020 | A1 | 11/2003 | Gilliam et al. | |
| 2004/0011811 | A1 | 1/2004 | McLelland et al. | |
| 2004/0118848 | A1 | 6/2004 | Marshall | |
| 2004/0159661 | A1 | 8/2004 | Aochi | |
| 2004/0238553 | A1 | 12/2004 | Lane et al. | |
| 2005/0035118 | A1 | 2/2005 | Garg et al. | |
| 2005/0173442 | A1 | 8/2005 | Gilliam et al. | |
| 2005/0247708 | A1 | 11/2005 | Golden | |
| 2005/0247709 | A1 | 11/2005 | Atkins et al. | |
| 2006/0027585 | A1 | 2/2006 | Clamage | |
| 2006/0042897 | A1 | 3/2006 | Sanderson | |
| 2006/0076352 | A1 | 4/2006 | Peterson et al. | |
| 2006/0081641 | A1 | 4/2006 | Habeger et al. | |
| 2006/0131347 | A1 | 6/2006 | Nottingham et al. | |
| 2006/0156811 | A1 | 7/2006 | Borowski et al. | |
| 2006/0191933 | A1 | 8/2006 | Hicks et al. | |
| 2006/0201946 | A1 | 9/2006 | Witt | |
| 2006/0207963 | A1 | 9/2006 | Little et al. | |
| 2006/0219652 | A1 | 10/2006 | Grant et al. | |
| 2006/0273118 | A1 | 12/2006 | Walsh et al. | |
| 2007/0015046 | A1 | 1/2007 | Kim et al. | |
| 2007/0045315 | A1 | 3/2007 | Evans et al. | |
| 2007/0221605 | A1 | 9/2007 | Pugne et al. | |
| 2007/0235462 | A1 | 10/2007 | Omdoll et al. | |
| 2007/0284276 | A1 | 12/2007 | Luttik et al. | |
| 2008/0035637 | A1 | 2/2008 | Shehadey et al. | |
| 2008/0041861 | A1 | 2/2008 | Crawford et al. | |
| 2008/0156805 | A1 | 7/2008 | Perry et al. | |
| 2008/0156806 | A1 | 7/2008 | Perry et al. | |
| 2008/0156808 | A1 * | 7/2008 | Perry | B65D 25/2897 220/560.03 |

(56) References Cited

U.S. PATENT DOCUMENTS

| | | | |
|---|---|---|---|
| 2008/0156858 | A1 | 7/2008 | Perry et al. |
| 2008/0173657 | A1 | 7/2008 | Perry et al. |
| 2009/0014457 | A1 | 1/2009 | Bennett |
| 2009/0032545 | A1 | 2/2009 | Zeiler et al. |
| 2009/0039708 | A1 | 2/2009 | Sanfilippo et al. |
| 2009/0152280 | A1 | 6/2009 | Luburic |
| 2009/0159607 | A1 | 6/2009 | Kratzer |
| 2009/0230177 | A1 | 9/2009 | Robertson et al. |
| 2009/0255942 | A1 | 10/2009 | Omdoll et al. |
| 2009/0289066 | A1 | 11/2009 | DiPietro et al. |
| 2009/0314775 | A1 | 12/2009 | Dietrich et al. |
| 2010/0108670 | A1 | 5/2010 | Perry et al. |
| 2010/0180553 | A1 | 7/2010 | Tilton |
| 2010/0264156 | A1 | 10/2010 | Vandamme et al. |
| 2010/0294767 | A1 | 11/2010 | Catteau et al. |
| 2010/0308044 | A1 | 12/2010 | Perry et al. |
| 2010/0308065 | A1 | 12/2010 | Vandamme et al. |
| 2010/0308066 | A1 | 12/2010 | Perry et al. |
| 2011/0186570 | A1 | 8/2011 | Perry et al. |
| 2011/0006066 | A1 | 11/2011 | Vandamme et al. |
| 2014/0097183 | A1 | 4/2014 | McGrath |
| 2014/0374429 | A1 | 12/2014 | Perry et al. |
| 2015/0129597 | A1 | 5/2015 | McBroom |

FOREIGN PATENT DOCUMENTS

| | | | |
|---|---|---|---|
| CN | 2936980 | | 8/2007 |
| CN | 201144030 | | 11/2008 |
| CN | 101616847 | A | 12/2009 |
| CN | 101939229 | A | 1/2011 |
| CN | 201737270 | U | 2/2011 |
| CN | 203698935 | U | 7/2014 |
| DE | 19701101 | | 7/1998 |
| DE | 19725698 | | 12/1998 |
| EP | 0356322 | | 1/1993 |
| EP | 0648681 | | 1/1994 |
| EP | 0609650 | | 8/1994 |
| EP | 0700836 | | 8/1995 |
| EP | 0631941 | | 9/1996 |
| EP | 0957034 | | 11/1999 |
| EP | 1129957 | | 9/2001 |
| EP | 1156157 | | 11/2001 |
| EP | 1512637 | | 3/2005 |
| EP | 1336569 | | 6/2005 |
| EP | 1529737 | | 3/2007 |
| FR | 2719558 | | 11/1995 |
| FR | 2747107 | | 10/1997 |
| GB | 2059920 | | 4/1981 |
| JP | 8183556 | | 7/1996 |
| JP | 8217108 | | 8/1996 |
| JP | 10258841 | | 9/1998 |
| JP | 2001019006 | | 1/2001 |
| JP | 2002209770 | | 7/2002 |
| JP | 2004136959 | | 5/2004 |
| JP | 2004329382 | | 11/2004 |
| JP | 2005022757 | | 1/2005 |
| JP | 2006111294 | | 3/2006 |
| JP | 2006160299 | | 6/2006 |
| JP | 2007099281 | | 4/2007 |
| JP | 2007099287 | | 4/2007 |
| JP | 2007099294 | | 4/2007 |
| JP | 2007137510 | | 6/2007 |
| JP | 2008063009 | | 3/2008 |
| JP | 2008296929 | | 12/2008 |
| KR | 20020007210 | | 1/2001 |
| KR | 20020025817 | | 4/2002 |
| KR | 20030072440 | | 9/2003 |
| KR | 20030089935 | | 11/2003 |
| KR | 10-2002-0040057 | | 1/2004 |
| KR | 20040005481 | | 1/2004 |
| KR | 20050027042 | | 3/2005 |
| KR | 20050019526 | | 12/2005 |
| KR | 2004030400000 | | 12/2005 |
| KR | 10-2002-0027862 | | 4/2009 |
| NL | 1031829 | | 11/2007 |
| TW | 200835631 | A | 9/2008 |
| WO | 199317920 | | 9/1993 |
| WO | 199511834 | | 5/1995 |
| WO | 199846494 | | 10/1998 |
| WO | 199915423 | | 4/1999 |
| WO | 151378 | | 7/2001 |
| WO | 03051732 | C | 6/2003 |
| WO | 2005075314 | | 8/2005 |
| WO | 07131806 | | 11/2007 |
| WO | 07142522 | | 12/2007 |
| WO | 2007137776 | | 12/2007 |
| WO | 2008019980 | | 2/2008 |
| WO | 2008083141 | | 7/2008 |
| WO | 2008149006 | | 12/2008 |
| WO | 2008149007 | | 12/2008 |
| WO | 2009081050 | | 7/2009 |
| WO | 2010141841 | | 12/2010 |
| WO | 2010141844 | | 12/2010 |
| WO | 2013163583 | | 10/2013 |

OTHER PUBLICATIONS

International Search Report for PCT/US2007/088793 dated Jun. 10, 2008.
International Preliminary Report on Patentability for PCT/US2007/088793 dated Jun. 30, 2009.
International Search Report for PCT/US2010/037436 dated Aug. 12, 2010.
International Search Report and Written Opinion from PCT/US2010/037436 dated Aug. 9, 2013.
International Search Report from PCT/US2013/038468 dated Aug. 11, 2013.
Notice of Abandonment for U.S. Appl. No. 11/645,887 dated Dec. 5, 2008.
Notice of Abandonment for U.S. Appl. No. 11/964,491 dated Dec. 5, 2008.
Notice of Abandonment for U.S. Appl. No. 11/964,513 dated Dec. 5, 2008.
Notice of Abandonment U.S. Appl. No. 11/964,526 dated Dec. 5, 2008.
Notice of Abandonment for U.S. Appl. No. 11/964,547 dated Dec. 5, 2008.
Restriction/Election for U.S. Appl. No. 12/478,885 dated Nov. 25, 2011.
Response to Restriction/Election for U.S. Appl. No. 12/478,885 dated Dec. 16, 2011.
Office Action in U.S. Appl. No. 12/478,885 dated Mar. 13, 2012.
Amendment A/Response to Office Action in U.S. Appl. No. 12/478,885 dated May 17, 2012.
Office Action in U.S. Appl. No. 12/478,885 dated Oct. 9, 2012.
Office Action in U.S. Appl. No. 12/520,652 dated Dec. 12, 2011.
Response/Amendment A in U.S. Appl. No. 12/520,652 dated Mar. 5, 2012.
Final Office Action in U.S. Appl. No. 12/520,652 dated May 10, 2012.
Response/Amendment B in U.S. Appl. No. 12/520,652 dated Jun. 28, 2012.
Notice of Allowance in U.S. Appl. No. 12/534,320 dated Mar. 21, 2013.
Notice of Allowance in U.S. Appl. No. 12/520,652 dated Jul. 11, 2012.
Office Action in U.S. Appl. No. 12/534,320 dated Mar. 22, 2012.
Office Action in U.S. Appl. No. 12/534,320 dated Nov. 28, 2012.
Office Action from U.S. Appl. No. 13/892,052 dated Jan. 16, 2014.
Preliminary Amendment A in U.S. Appl. No. 13/083,207 dated Apr. 8, 2011.
Preliminary Amendment B in U.S. Appl. No. 13/083,207 dated Apr. 13, 2011.
Office Action in U.S. Appl. No. 13/083,207 dated Sep. 5, 2012.
Response to Office Action in U.S. Appl. No. 13/083,207 dated Dec. 5, 2012.
Notice of Non-Compliant Amendment in U.S. Appl. No. 13/083,207 dated Dec. 11, 2012.

(56) References Cited

OTHER PUBLICATIONS

Response to Notice of Non-Compliant Amendment in U.S. Appl. No. 13/083,207 dated Jan. 3, 2013.
Notice of Allowance in U.S. Appl. No. 13/083,207 dated Jan. 24, 2013.
Office Action in Columbian Appl. No. 09066736 dated Sep. 18, 2012.
Office Action in Israeli Appl. No. 199511 dated Feb. 10, 2012.
Office Action in Israeli Appl. No. 199511 reported by Foreign Associate Jul. 9, 2013.
Office Action in Japanese Appl. No. 2009-544244 dated Jul. 31, 2012.
Office Action in Mexican Appl. No. MX/a/2009/007052 dated Mar. 1, 2012.
ASG vitamin package of 1990.
Hardware Source hinge store-where-you find all the hinges you will ever need, www.hardwaresource.com/index.asp. Dec. 26, 2006, pp. 1-3.
Living Hinge Design, http://engr.bd.psu.edu/pkoch/plasticdesignliving_hinge.htm, Nov. 6, 2006, pp. 1-8.
Living Hinge, http://efunda.com/designstandards/plastic_design/hinge.cfm Nov. 2, 2006 pp. 1-3.
Request for Inter Partes Reexamination of U.S. Pat. No. 7,040,500 dated Nov. 7, 2008, pp. 1-97.
Office Action for Dominican Republic Patent Application No. P2009-0158 reported by associate Jul. 25, 2013.
Notice of Allowance from U.S. Appl. No. 12/478,885 dated Sep. 18, 2013.
International Search Report from PCT/US2013/038468 dated Nov. 8, 2013.
Response to Office Action from U.S. Appl. No. 13/892,052 dated May 16, 2014.
Notice of Allowance from U.S. Appl. No. 13/892,052 dated Aug. 6, 2014.
Office Action from Canadian Application No. 2,674,004 dated Apr. 7, 2014.
Office Action from Canadian Application No. 2,674,004 dated Mar. 3, 2015.
Office Action from Canadian Application No. 2,871,792 dated Feb. 17, 2016.
Office Action from Canadian Application No. 2,892,925 dated Oct. 7, 2015.
First Office Action from Chinese Application No. 201380022123.9 dated Sep. 21, 2015.
Second Office Action from Chinese Application No. 201380022123.9 dated May 17, 2016.
Communication from EP Application No. 07869878.4 dated Sep. 15, 2015.
Exam Report from Malaysian Application No. PI 20092696 dated Apr. 15, 2014.
First Exam Report from New Zealand Application No. 630929 dated May 25, 2015.
Search Report and Written Opinion from Singapore Application No. 11201406809T dated Sep. 17, 2015.
Restriction Requirement from U.S. Appl. No. 29/470,645 dated Jan. 2, 2015.
Response to Restriction/Election for U.S. Appl. No. 29/470,645 dated Feb. 24, 2015.
Notice of Allowance from U.S. Appl. No. 29/470,645 dated Mar. 6, 2015.
Notice of Allowance from U.S. Appl. No. 29/523,835 dated Oct. 19, 2015.
Office Action from U.S. Appl. No. 14/395,841 dated Aug. 14, 2015.
Amendment from U.S. Appl. No. 14/395,841 dated Nov. 16, 2015.
Notice of Allowance from U.S. Appl. No. 14/395,841 dated Mar. 11, 2016.
Office Action from U.S. Appl. No. 14/483,852 dated Nov. 19, 2015.
Amendment from U.S. Appl. No. 14/483,852 dated Mar. 11, 2016.
Supplemental Amendment from U.S. Appl. No. 14/483,852 dated May 17, 2016.
Applicant Initiated Interview Summary from U.S. Appl. No. 14/483,852 dated May 18, 2016.
Notice of Allowance from U.S. Appl. No. 14/483,852 dated Sep. 16, 2016.
Amendment A/Response to Office Action in U.S. Appl. No. 12/534,320 dated May 25, 2012.
Extended European Search Report from European Application No. 16162082.8 dated Sep. 20, 2016.
Notice of Allowance from U.S. Appl. No. 14/483,852 dated Aug. 12, 2016.
Office Action from Vietnamese Application 1-2014-03559 dated Nov. 27, 2017.
Office Action from Philippine Appl. No. 1-2014-502392 dated Aug. 10, 2017.
First Office Action from Chinese Application No. 201610712836.3 dated Sep. 25, 2017.
Office Action from Taiwan Application No. 102118497 dated Nov. 2, 2017.

* cited by examiner

CONTAINER

CROSS-REFERENCE TO RELATED APPLICATION

This application is a divisional application of U.S. patent application Ser. No. 14/395,841, entitled CONTAINER and filed on Oct. 21, 2014, which is the U.S. national stage entry of PCT/US2013/038468, with an international filing date of Apr. 26, 2013 and claims the benefit of and priority to U.S. Provisional Patent Application Ser. No. 61/639,857, entitled PRODUCT CONTAINMENT SYSTEM and filed Apr. 27, 2012, the entire disclosures of which are incorporated herein by reference, to the extent that it is not conflicting with the present application.

BACKGROUND

Many consumer products are packaged in granular or powdered form, such as for example, infant formula, flour, coffee, and sugar. Stock keeping units of granular or powdered form which are sold in volumes larger than one-time use amounts require specific packaging. Such packaging must be suitable for storage until first time use and must provide adequate storage at the consumer site between subsequent uses. Adequately storing the product throughout the consumption cycle requires packaging which prohibits waste and contamination, is strong and durable, and is convenient to the user.

Multiple-use containers for power products are typically constructed of polymers. Such materials are subject to many variables that adversely result in product components being produced that can vary beyond acceptable dimensional tolerance limits. Also, polymeric materials can render mis-shaped component profiles due to unexpected shrinkage and warping. These types of manufacturing problems are especially pronounced in containers formed from assemblies that incorporate more than one component, such as where a top or lid and a collar assembly are fastened to a bottom part or base of a container.

Still other users experience problems with prior art containers that are inadequate for use in circumstances where the ambient air pressure external to the container changes drastically so as to create a significant pressure differential between the sealed interior space of the container and the external, ambient atmosphere. For example, when a container is packaged at a facility at sea-level pressure, and then shipped to consumers located at higher altitudes, the container will have a higher internal pressure, which creates a pressure differential that can be significant. If the pressure differential is large enough, the container may become distended, making it difficult to stack and store, and may even experience a breach, leading to contaminated and wasted product. The opposite situation can occur when containers that are filled and sealed at a higher altitude are shipped to lower altitude users. Upon opening, ambient air can rush into the interior space of the container and contaminate the contents.

When a container having a pressure differential is opened, the contents may again spill due to the very rapid pressure equalization ejecting a cloud of powdered or other type of product contents. Attempts to overcome these disadvantages have included thicker walled containers, which increases weight and material costs, as well as round and cylindrical containers that may have higher hoop stress strength, but which are less efficient and convenient to stack and store on a shelf.

A container is needed that addresses the many issues surrounding prior art containers, and which most importantly offers new and innovative ways to prevent and/or minimize contamination, spillage, and waste of product contained in such containers. A more durable container is needed that incorporates improved rigidity and strength characteristics that can expand the range of acceptable dimensional tolerances and that can adapt to and more readily accommodate unexpected mis-shaped container component profiles.

SUMMARY

The present application describes a container for use in packaging, such as for example, a container suitable for use in holding powder infant formula.

In an exemplary embodiment, a container has a collar, a lid and a seal. The container includes walls which define an interior space and an opening to the interior space. The collar is attached to the walls. The lid is attached to the collar for positioning between an open position and a closed position, and is adapted to cover the opening while in the closed position. A latching assembly is attached to an outer surface of the container and offers precise user control features which permit the lid is be easily engaged to and disengaged from the collar. The latch assembly may be comprised of two protrusions, one on the lid and one on the collar or container.

Further features and advantages of the invention will become apparent from the following detailed description made with reference to the accompanying drawings.

BRIEF DESCRIPTION OF THE DRAWINGS

Features and advantages of the general inventive concepts will become apparent from the following detailed description made with reference to the accompanying drawings.

DETAILED DESCRIPTION

Figure 1:
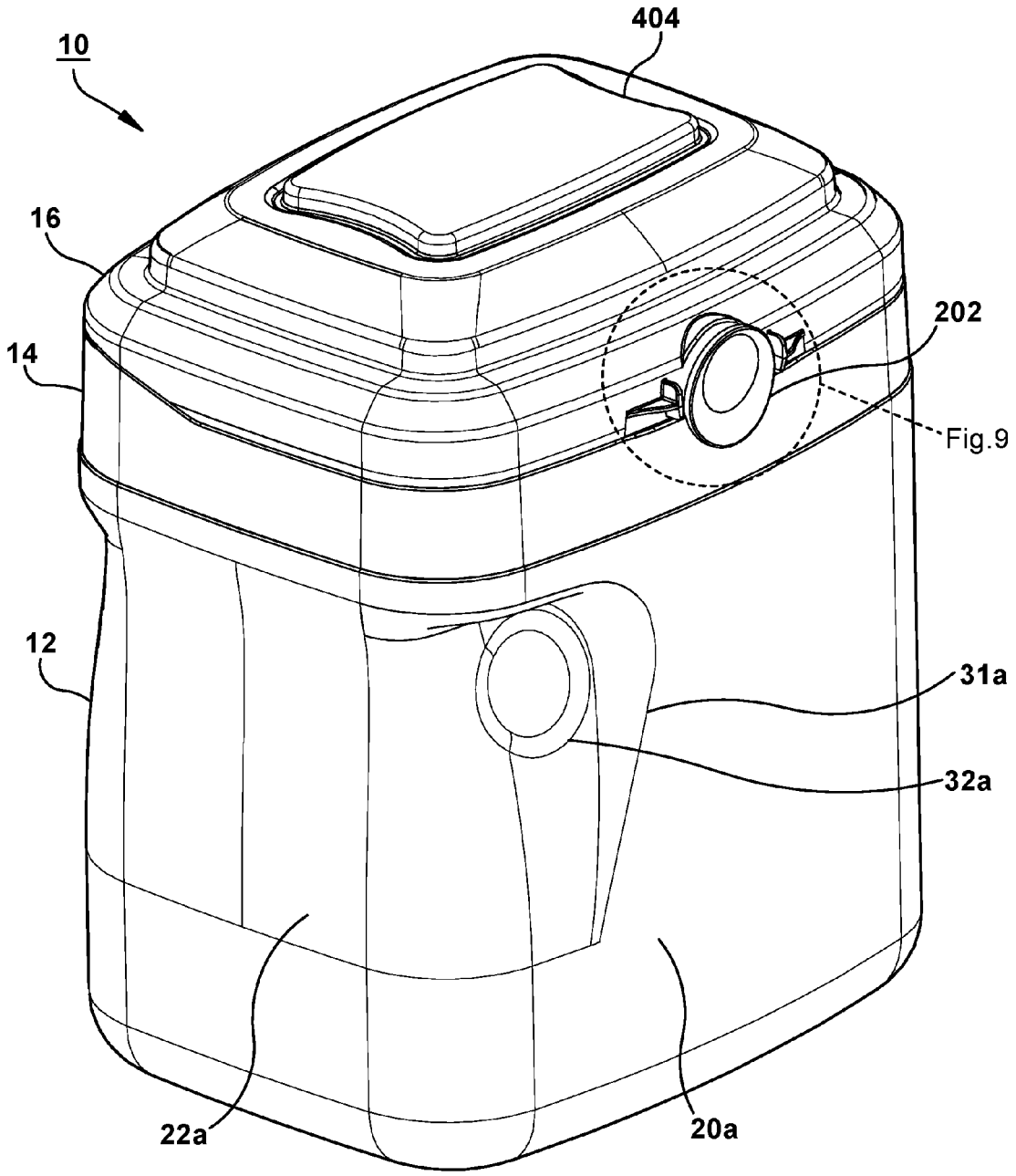
FIG. 1 is a front perspective view of a container.

This Detailed Description merely describes exemplary embodiments in accordance with the general inventive concepts and is not intended to limit the scope of the invention or the claims in any way. Indeed, the invention as described by the claims is broader than and unlimited by the exemplary embodiments set forth herein, and the terms used in the claims have their full ordinary meaning.

The general inventive concepts will now be described with occasional reference to the exemplary embodiments of the invention. This general inventive concept may, however, be embodied in different forms and should not be construed as limited to the embodiments set forth herein. Rather, these embodiments are provided so that this disclosure will be thorough and complete, and will fully convey the scope of the general inventive concepts to those skilled in the art.

Unless otherwise defined, all technical and scientific terms used herein have the same meaning as commonly understood by one of ordinary skill in the art encompassing the general inventive concepts. The terminology set forth in this detailed description is for describing particular embodiments only and is not intended to be limiting of the general inventive concepts. As used in this detailed description and the appended claims, the singular forms "a," "an," and "the" are intended to include the plural forms as well, unless the context clearly indicates otherwise.

Unless otherwise indicated, all numbers expressing quantities of ingredients, properties such as molecular weight, reaction conditions, percentages and so forth as used in the specification and claims are to be understood as being modified in all instances by the term "about." Accordingly, unless otherwise indicated, the numerical properties set forth in the specification and claims are approximations that may vary depending on the suitable properties sought to be obtained in embodiments of the present invention. Notwithstanding that the numerical ranges and parameters setting forth the broad scope of the general inventive concepts are approximations, the numerical values set forth in the specific examples are reported as precisely as possible. Any numerical values, however, inherently contain certain errors necessarily resulting from error found in their respective measurements.

The present application describes a container for use in packaging, such as for example, a container suitable for use in holding powder infant formula. The container provides an advantageous storage method for a granular or powdered product. The container offers improved durability, strength, sealing and convenience features.

One embodiment of the invention features a container having walls defining an interior space, a collar, a lid, and a latch. The interior space is suitable for storage of a powder. The walls include an upper portion which defines a sealing flange having an internal edge. The internal edge defines an opening to the interior space. The collar is attached to the upper portion. The lid is attached to the collar for positioning between an open position and a closed position. The lid is adapted to cover the opening while in the closed position. The latch is attached to an outer surface of the lid. In offering increased ease of operation, the latch may have an actuator rotatable in two directions relative to the lid and detachably engaging to a catch. The catch protrudes from an outside surface of the container. The latch may be comprised of a protrusion on the lid and the catch may be comprised of a protrusion on the collar or container.

Another embodiment of the invention features a container having two first walls and two second walls, a collar, a lid, a latch, and a seal. The two first walls are each wider than the two second walls to generally form an opening having a rectangular shape. The upper portion defines a sealing flange having an internal edge which defines an opening to the interior space. The collar is attached to an upper portion of the walls. The lid is attached to the collar for positioning between an open position and a closed position. The lid is adapted to cover the opening while in the closed position. The latch is attached to an outer surface of the lid and is detachably engaged to a catch. The seal protects the contents of the container after packaging, during shipment and during storage prior to sale. The seal is removably attached to the sealing flange and covering the opening to the interior space. The seal includes a tab and defines a gripping surface for a consumer to grasp. In offering increased ease of operation, the tab is positioned along a first wall for prohibiting tearing during removal.

Another embodiment of the invention features a container having walls, a collar, a lid, a latch, and a flexible gasket. The upper portion defines a sealing flange having an internal edge which defines an opening to the interior space. The collar is attached to an upper portion of the walls. The lid is attached to the collar for positioning between an open position and a closed position. The lid is adapted to cover the opening while in the closed position. The latch is attached to an outer surface of the lid and is detachably engaged to a catch. The flexible gasket is positioned to extend from an interior surface of the collar to removably rest against the sealing flange. The flexible gasket is arranged to remain biased against the sealing flange when the lid is in an open position. The flexible gasket has a vertical portion separated from an inwardly protruding portion by a trough.

Referring now to the drawings, a container 10 for holding a granular or powdered product is shown in FIGS. 1-4. The container is suitable for packaging of product at a manufacturing facility which is sold in volumes larger than one-time use amounts. The exemplary container discussed herein is suitable for use in packaging infant powder formula which is sold in multiple-use amounts. However, it should be understood that the invention can be practiced with any type of granular or powdered product, such as for example, flour, coffee, and sugar, and any packaged volume of granular or powdered product.

Now referring to FIG. 1, a container 10 having a receptacle 12, collar 14 and lid 16 is shown. The lid is hinged to the collar on the back side of the container. A user may rotate the lid between a closed position and an open position to access an interior space within the receptacle. In assembly, the interior space of the receptacle is filled with a powder. After a sealing layer is applied to the top of the receptacle to close an opening to the receptacle, the collar is secured to an upper portion of the receptacle by snapping protruding tabs of the collar into recesses in the exterior surface of the upper portion. An inside surface of the lid includes tabs for removably securing a scoop. A container having this general type of structure is discussed in U.S. Pat. No. 8,308,008, issued Nov. 13, 2012, which is incorporated herein by reference.

Figure 17:
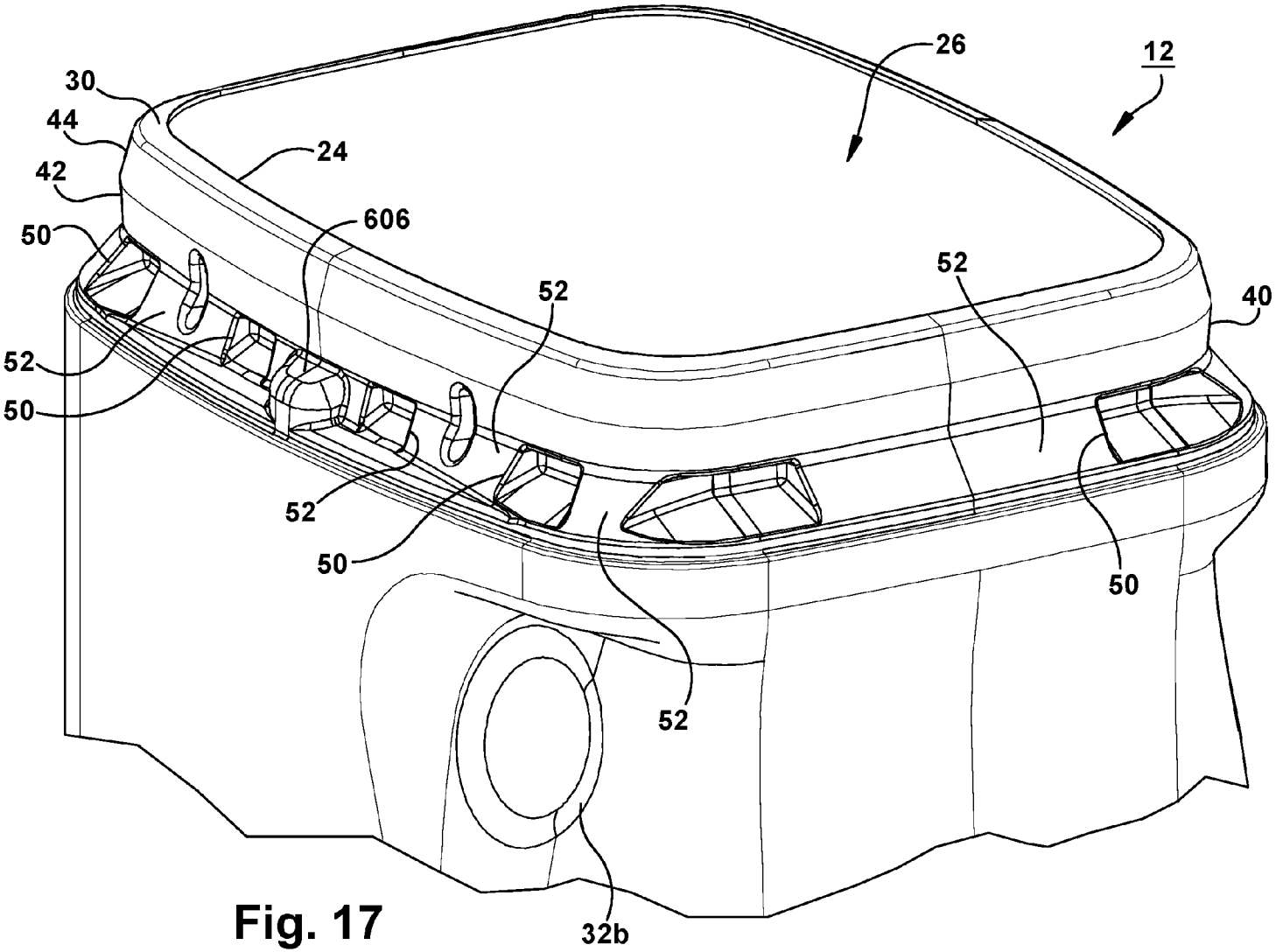
FIG. 17 is a perspective view of the receptacle of FIG. 1.

The receptacle 12 is shaped to define an interior space 26 for storing powder. The receptacle 12 has a bottom wall and four side walls to generally form a cuboid with an open top. The opening 24 provides access to the interior space 26 suitable for storing a powder product. During a packaging operation, the interior space is filled with powder and then sealed with a removable sealing layer. The exemplary receptacle 12 shown has at least two opposing and generally rectangular sides and a rectangular bottom side, i.e., is generally in the shape of a rectangular hexahedron. FIG. 17 is a perspective view of the top half of the receptacle 12 prior to assembly to other components of the container. It should be understood that the receptacle illustrated in the figures is for example only, and that walls of the container may be of alternative size, shape and structure in the practice of this invention.

Figure 2:
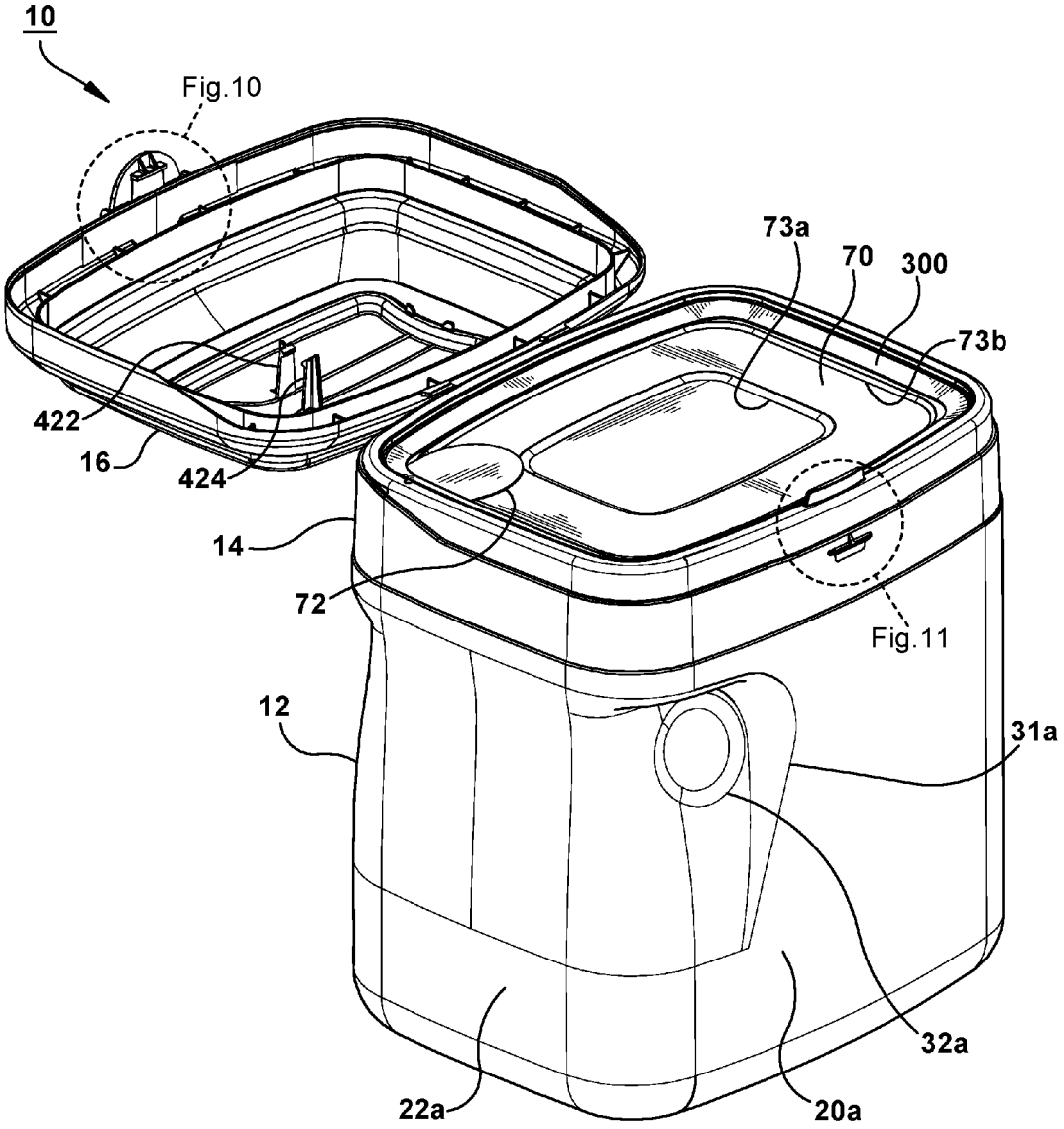
FIG. 2 is a front perspective view of the container of FIG. 1, shown with a lid of the container in an open position.
Figure 3:
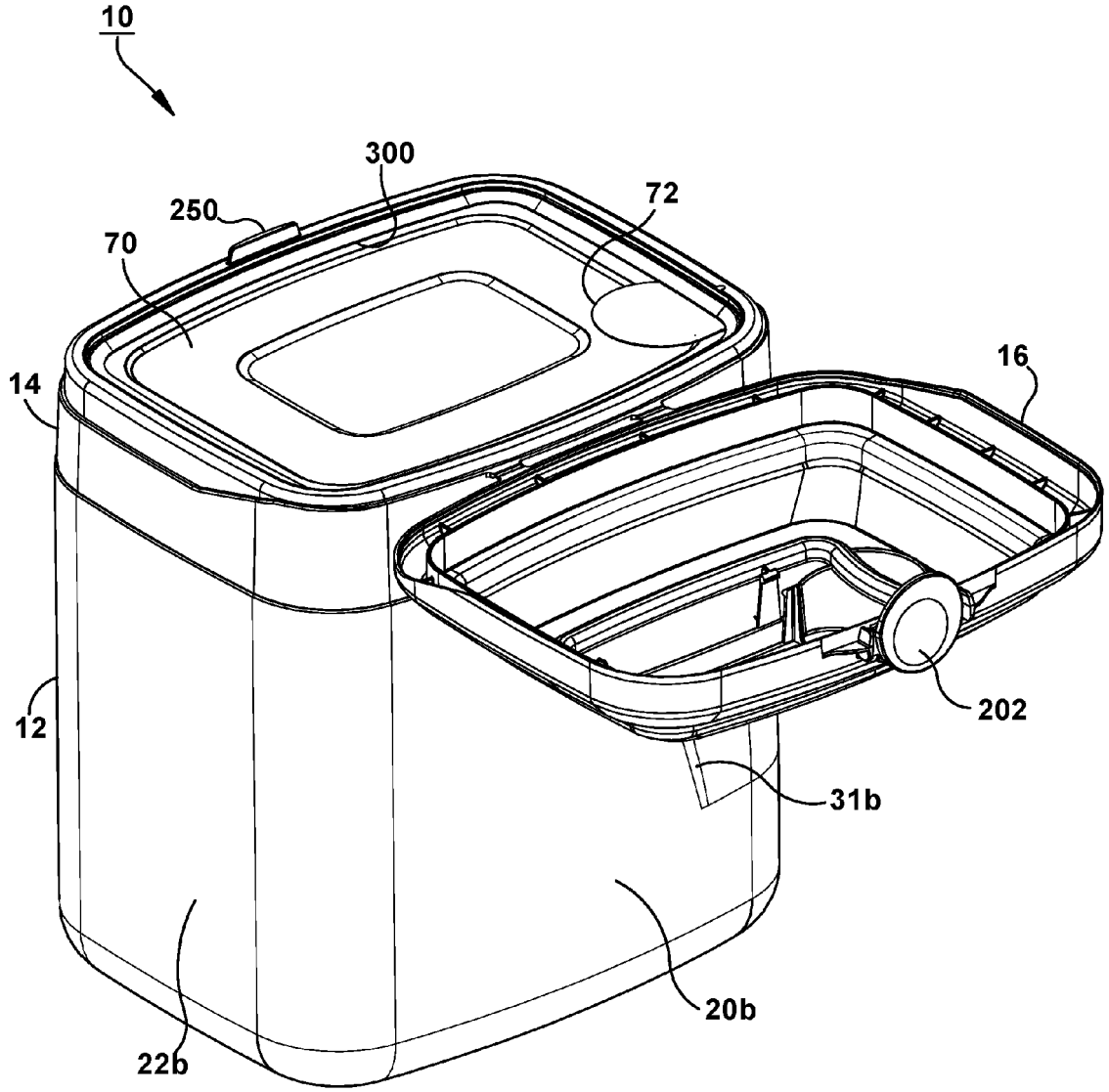
FIG. 3 is a rear perspective view of the container of FIG. 1, shown with a lid of the container in an open position.
Figure 20:
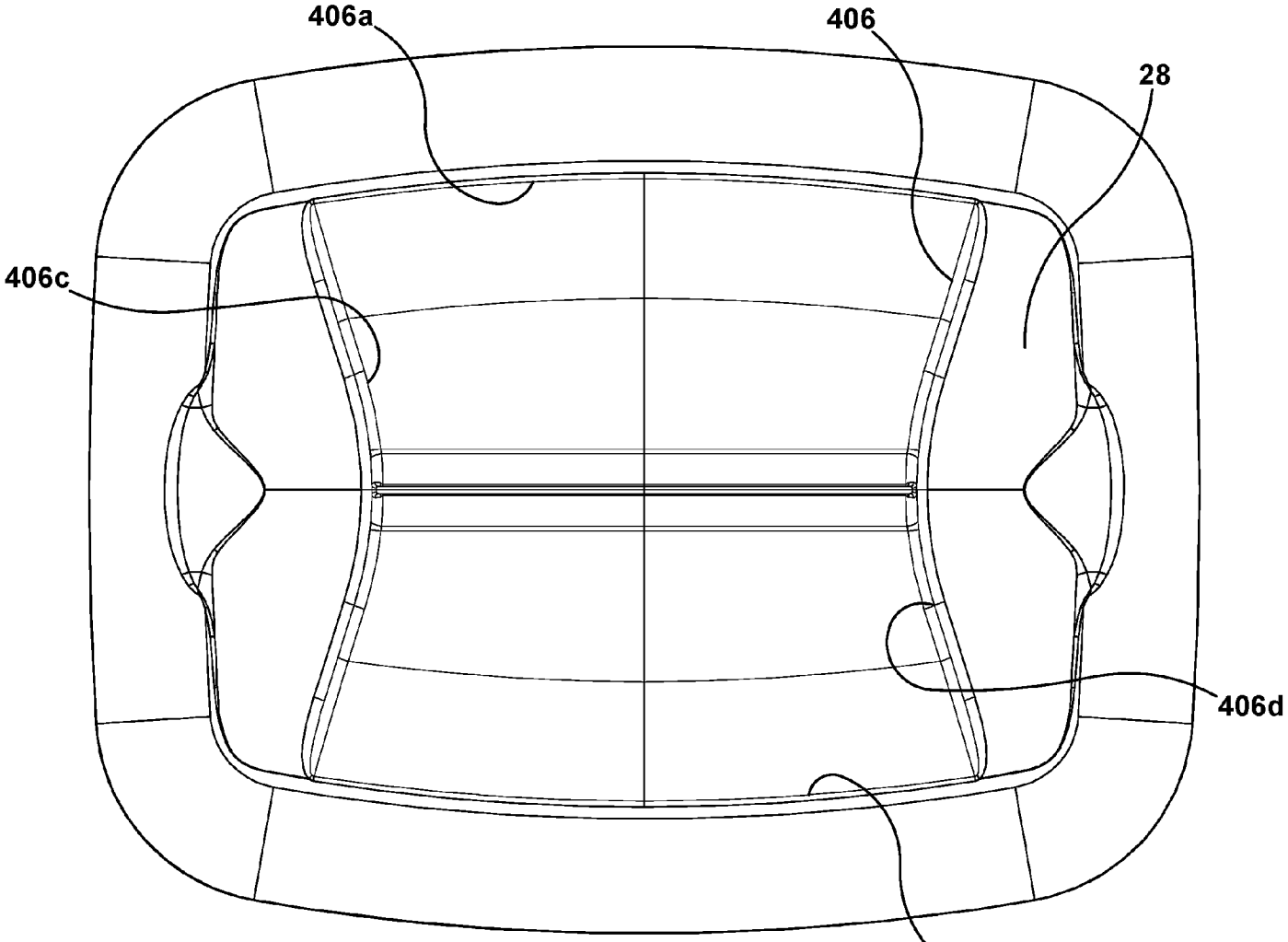
FIG. 20 is a bottom view of the container of FIG. 1.

The exemplary receptacle 12 is formed in part by four vertical walls and a bottom wall. Referring to FIGS. 1-3, the receptacle 12 generally includes two first walls, or front and rear walls, and two second walls, or side walls. A top view of the bottom wall 28 is illustrated in FIG. 20. Specifically, the first walls are a front wall 20*a* and a rear wall 20*b*, and the two second walls are a right side wall 22*a* and a left side wall 22*b*. In regard to a horizontal measurement along the exterior surface of the container, the front wall 20*a* and rear wall 20*b* are generally the same width, as are the right wall 22*a* and the left wall 22*b* generally the same width. As shown in the figures, each of the front wall 20*a* and rear wall 20*b* are of a greater width than each of the right side wall 22*a* and a left side wall 22*b*. As such, the walls of the exemplary receptacle 12 generally form the shape of a rectangular hexahedron.

The walls are constructed to permit a firm grip by the user during removal of the sealing layer. The front wall 20*a* has a recess 31*a* positioned to facilitate gripping of the container 10 by one or more digits of the user. The rear wall 20*b* also has a recess 31*b* positioned to facilitate gripping of the container 10 by one or more digits of the user. The recess 31*a* can further have an additional recess 32*a* to indicate the precise location within the recess 31*a* for the placement of a single digit of the user, such as for example, a thumb. The recess 32*a* is smaller in area than the recess 31*a*. The recess 31*b* can further have an additional recess 32*b* to indicate the precise location in the recess 31*b* for the placement of the desired digit of the user. The recess 32*b* is smaller in area than the recess 31*b*. The recesses 32*a* and 32*b* are preferably circular in shape, but other shapes may be used in the practice of the invention.

The walls of the container also form an upper portion which is advantageously shaped for strength, durability and strength. The upper portion defines a sealing flange having an internal edge which defines an opening to the interior space. The upper portion includes structural features allowing a secure connection of the collar and lid after application of the sealing layer.

The container 10 is also adapted for stacking a plurality of units to maximize containers per cubic feet, by increasing the number of containers per stack height, and thus, the number of containers per shipping pallet. As shown in FIG. 1, a dove-shaped protrusion 404 is located on the top of the lid 16. The protrusion 404 is cooperatively shaped to insert into a recess 406 on the bottom wall 28 of the receptacle 12, as seen in FIG. 20. The recess is formed by two opposing, convex and short walls 406*c*, 406*d* and two opposing, concave and long walls 406*a*, 406*b*. It is believed that the dove-shaped protrusion 404 and dove-shaped recess 406 also promotes locking between contiguously stacked containers, i.e., a stack formed by a plurality of containers is more resistant to twisting along the height of the stack.

Figure 4:
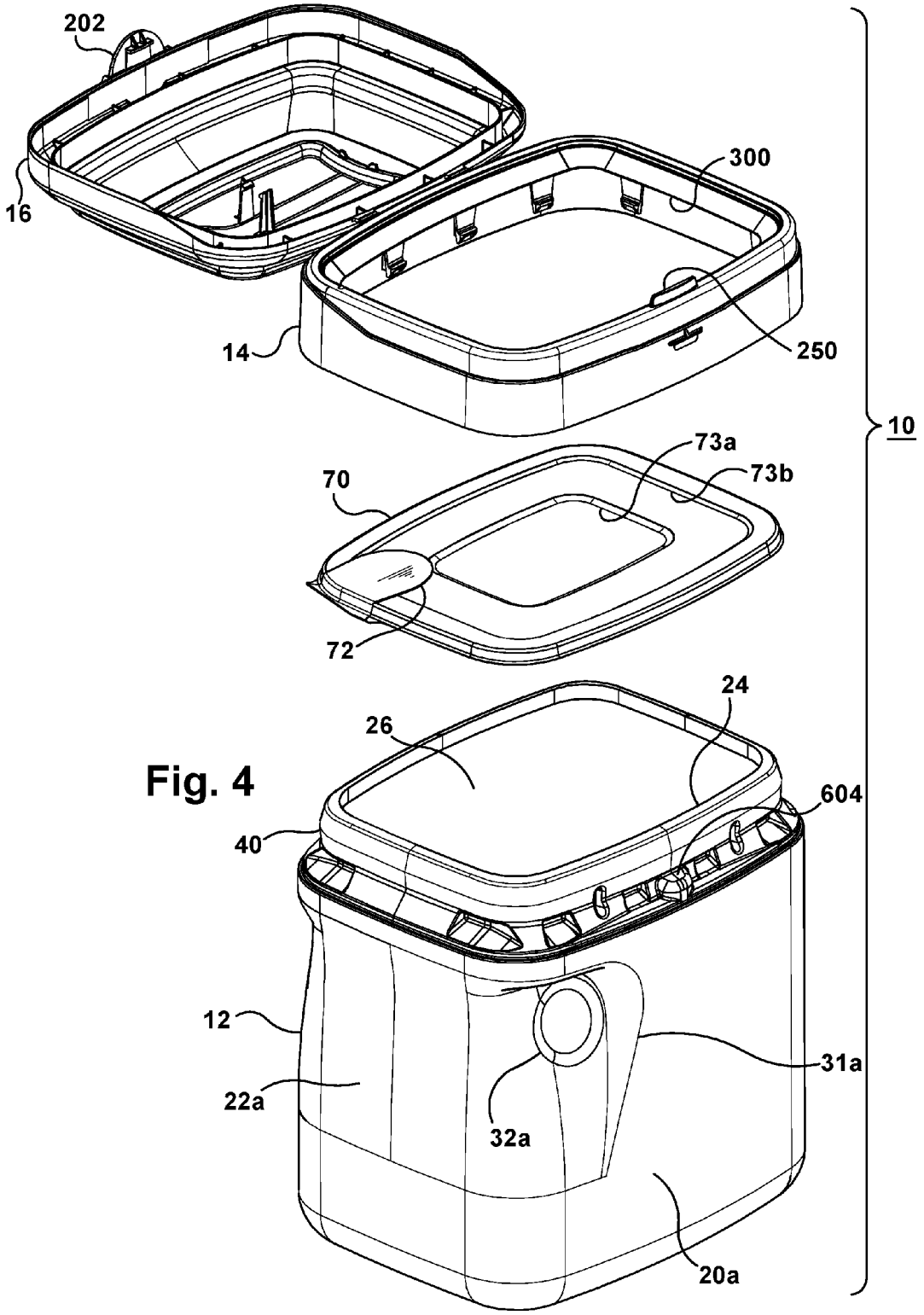
FIG. 4 is an assembly view of the container of FIG. 1, shown with a lid of the container in an open position.
Figure 18:
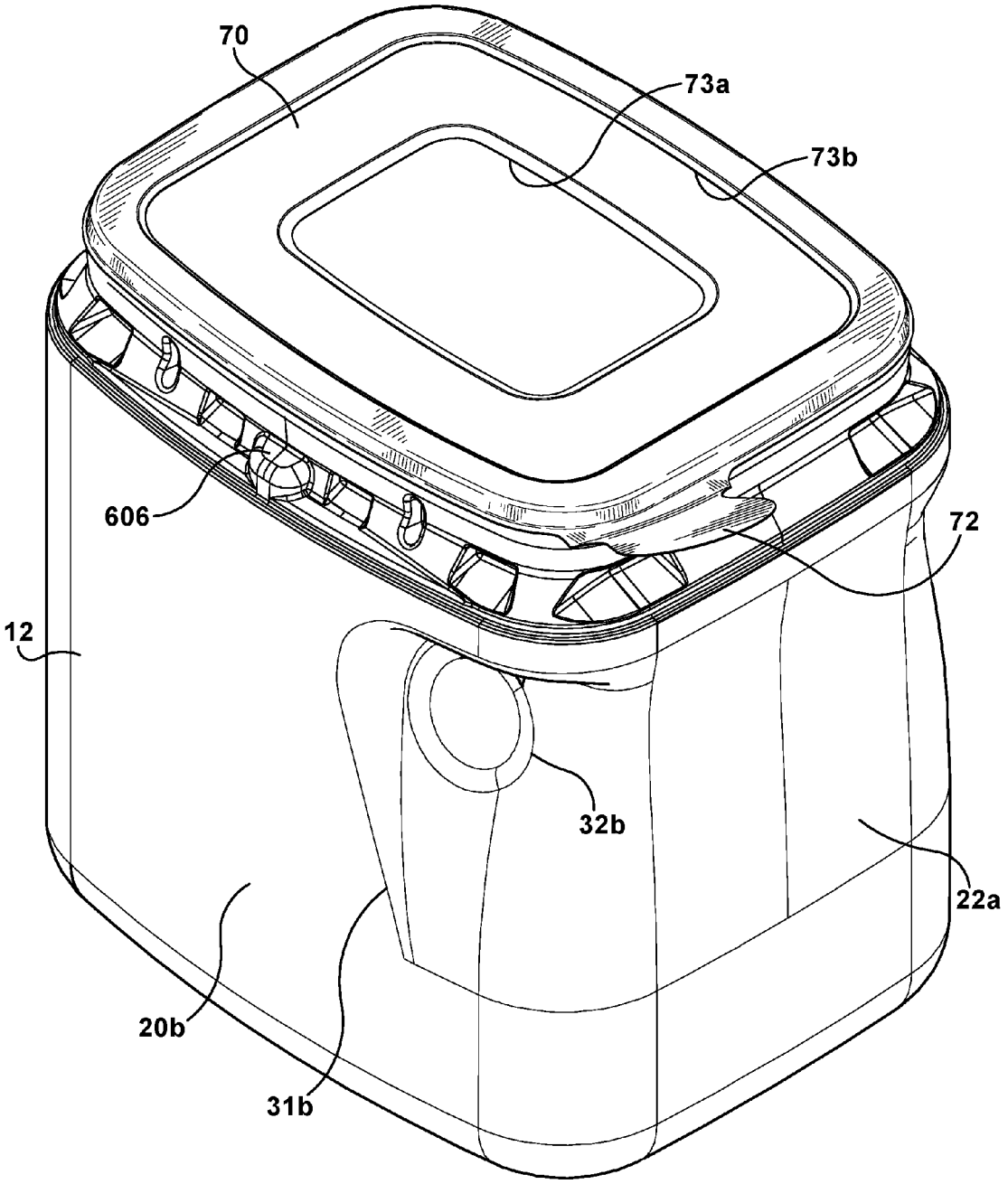
FIG. 18 is a top perspective view of the container of FIG. 1, shown with the lid and the collar of the container removed.

Referring now to FIGS. 4, 17 and 18, the upper portion 40 of the receptacle 12 is adapted for secure attachment by the collar. One or more engagement recesses or indentations 50 are spaced around the circumference of the upper portion of the receptacle. The recesses 50 are laterally separated by strengthening bridges 52. The spaced apart bridge 52 arrangement imparts improved strength and rigidity capabilities to the upper portion 40 of the receptacle 12, which, in turn, improves the crippling strength of the container and the rigidity of the upper portion 40 when the collar 14 is fitted together with the receptacle 12.

Figure 5:
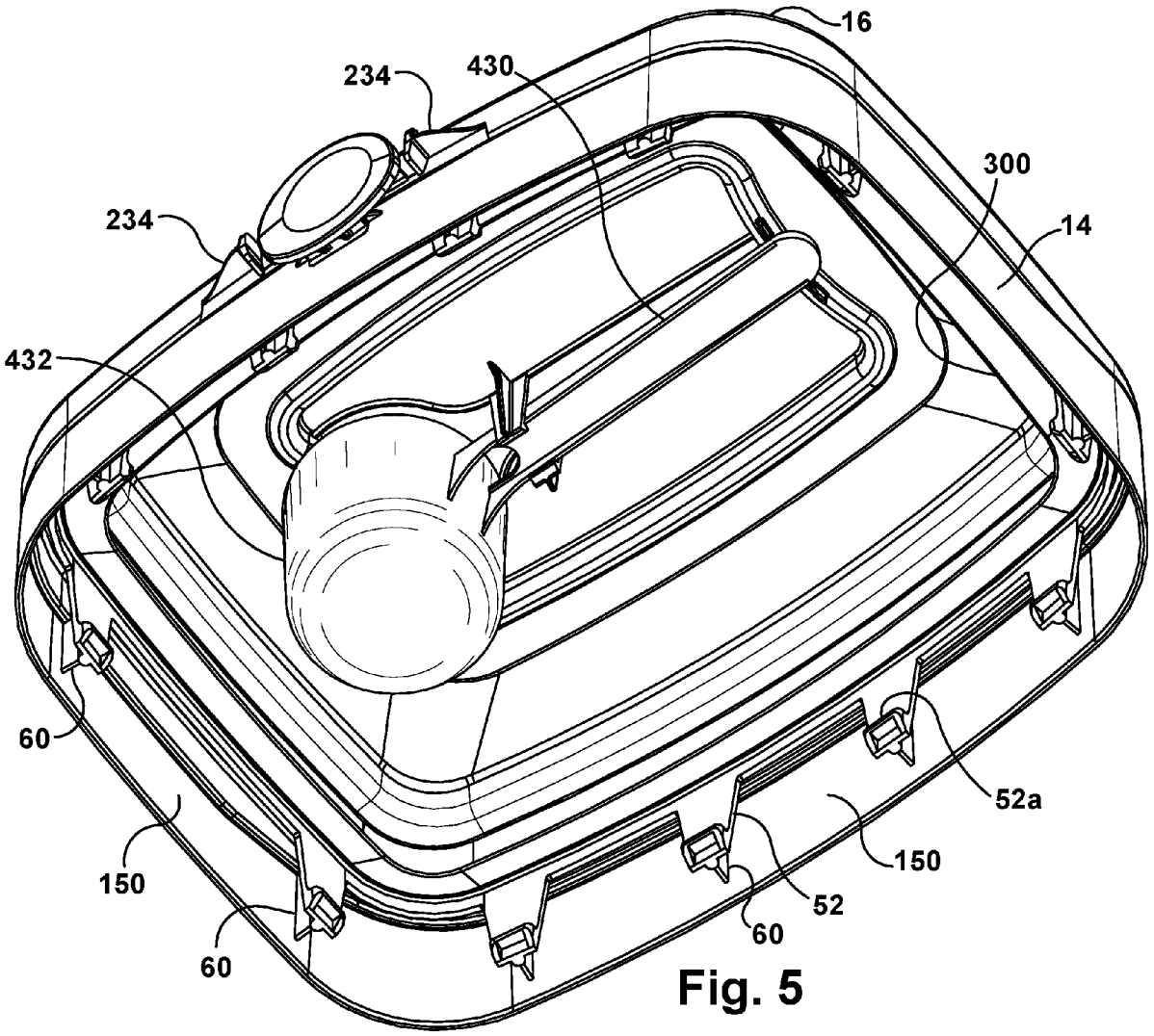
FIG. 5 is a bottom perspective view of the lid and collar of FIG. 1, shown with the lid of the container in a closed position and a scoop installed.
Figure 16:
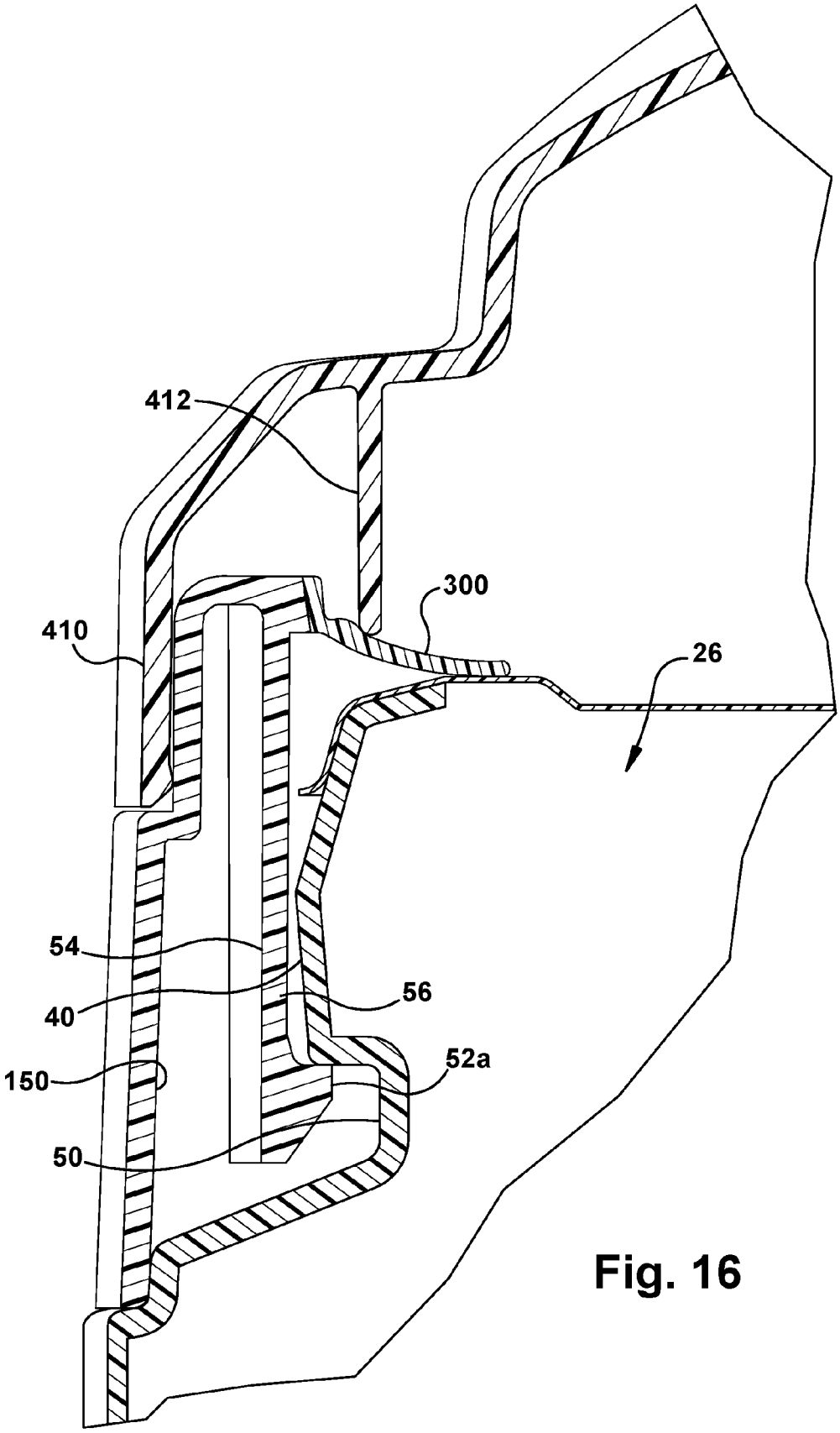
FIG. 16 is an enlarged sectional view of a portion of the container of FIG. 1, showing a tab and recess connection.

The upper portion of the receptacle includes additional stabilizing features. Discussed herein, the upper portion 40 of the receptacle provides stability to protruding tabs of the collar. As shown in FIG. 17, the upper portion 40 includes a planar surface 42 located above the recesses 50 and bridges 52. The planar surface 42 is of a length to provide a backing surface to prohibit movement of the tab. For example, FIG. 16 shows an exemplary tab 54 having an inside surface 56. Movement of the tab 54 is prohibited in a direction toward the interior space 26. As best seen in FIG. 5, a spine 60 runs the length of the tab 54 between the tab and an inside wall 150 of the collar 12. This construction adds reinforcement and stability to the collar attachment to the lid by prohibiting movement of the tab 54 in a direction away from the interior space 26. This configuration is improved over known bridge and recess connections.

Figure 7:
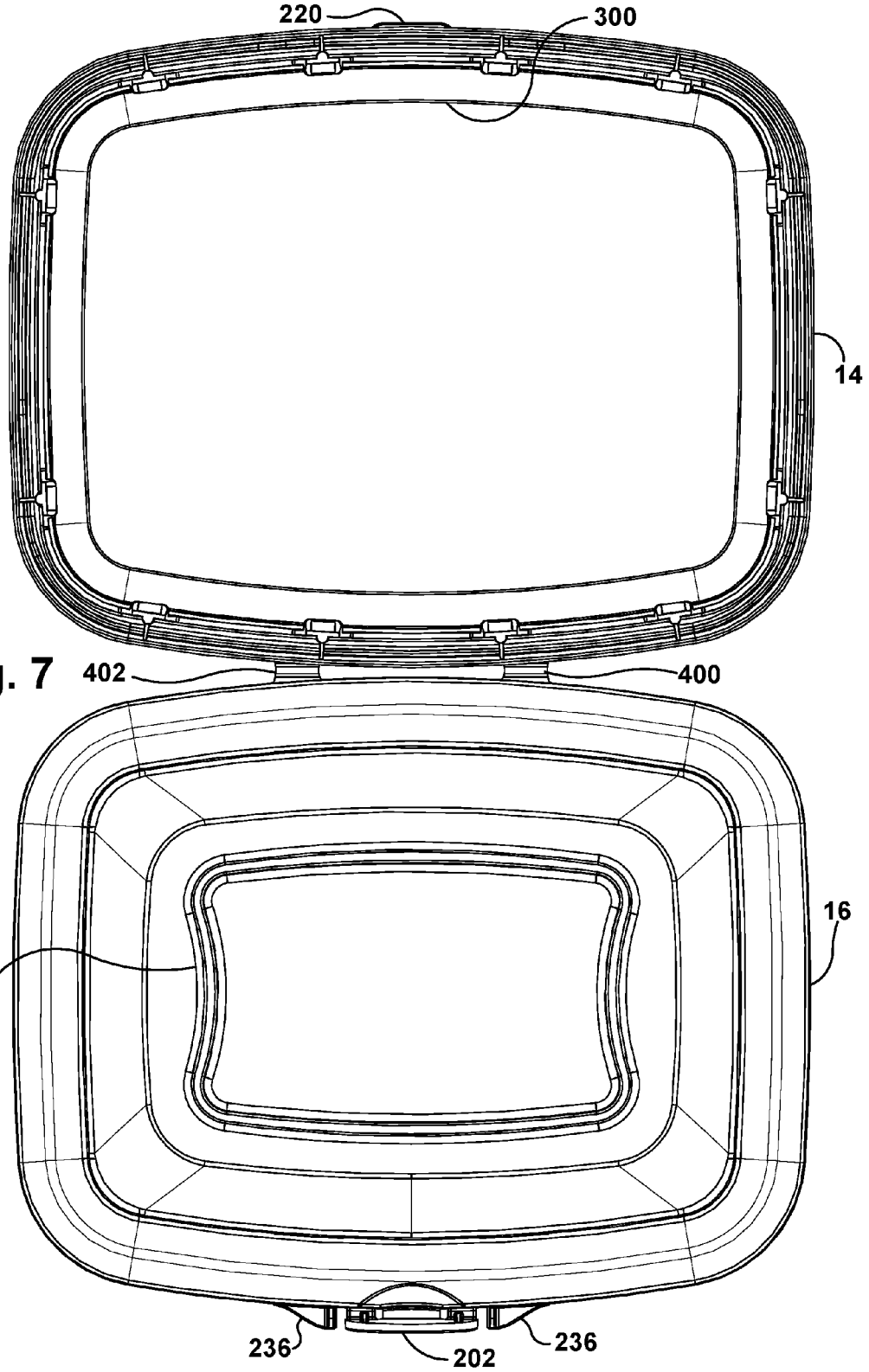
FIG. 7 is a top view of the lid and collar of FIG. 1, shown with a lid of the container in an open position.
Figure 8:
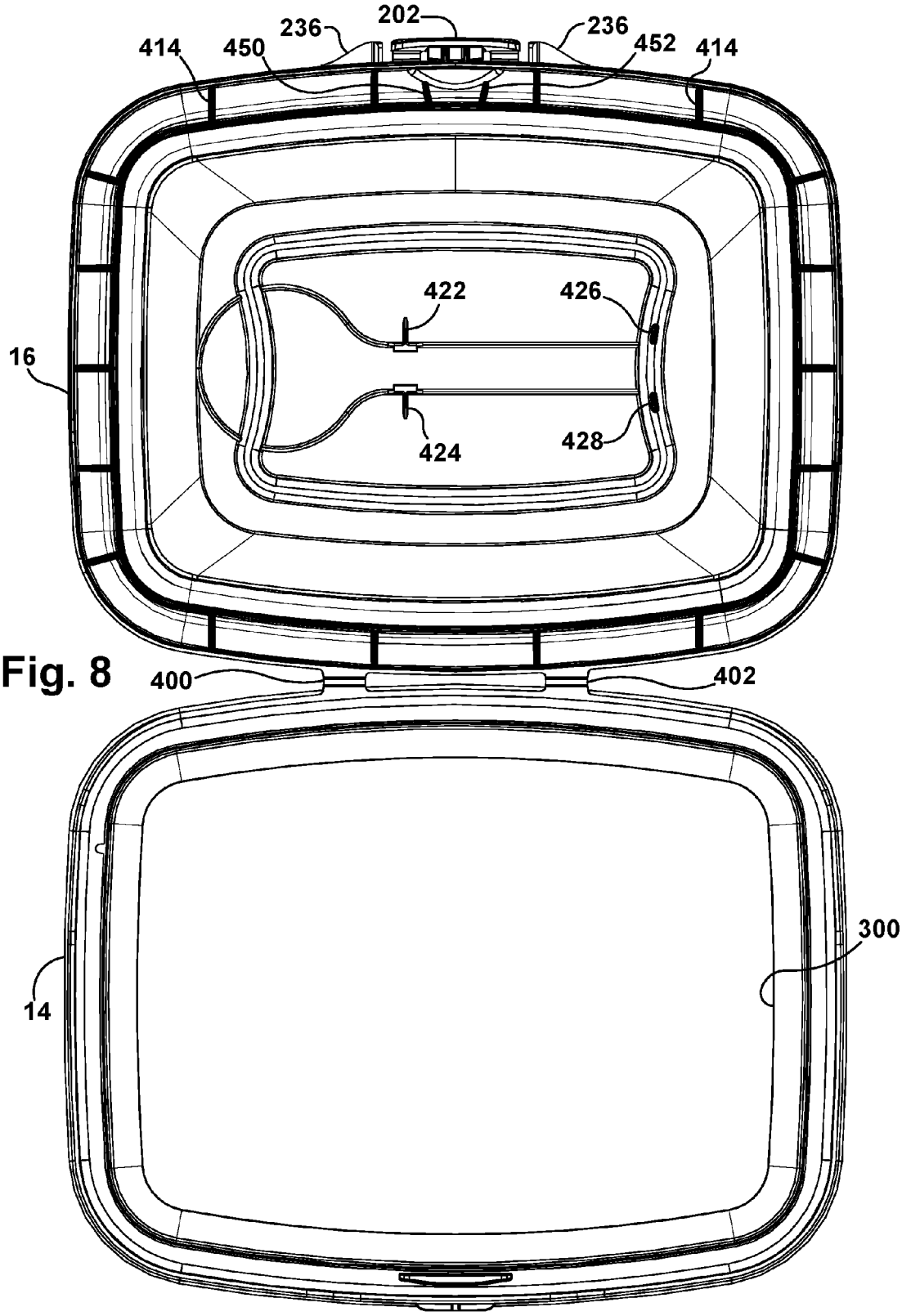
FIG. 8 is a bottom view of the lid and collar of FIG. 1, shown with a lid of the container in an open position.

As shown in the assembly view of FIG. 4, the collar 14 and the lid 16 attach to an upper portion 40 of the receptacle 12 to complete the assembly of the container 10. A bottom perspective view of the collar 14 and lid 16 in a closed position is shown in FIG. 5, and the collar and lid are shown in an open position in FIGS. 8 and 9. In the illustrated example and as best shown in FIGS. 7 and 8, the lid 16 and collar 14 are a uniform piece joined by two folding hinges 400, 402. About the hinges 400, 402, the lid is positionable relative the collar between an open position and a closed position.

Figure 10:
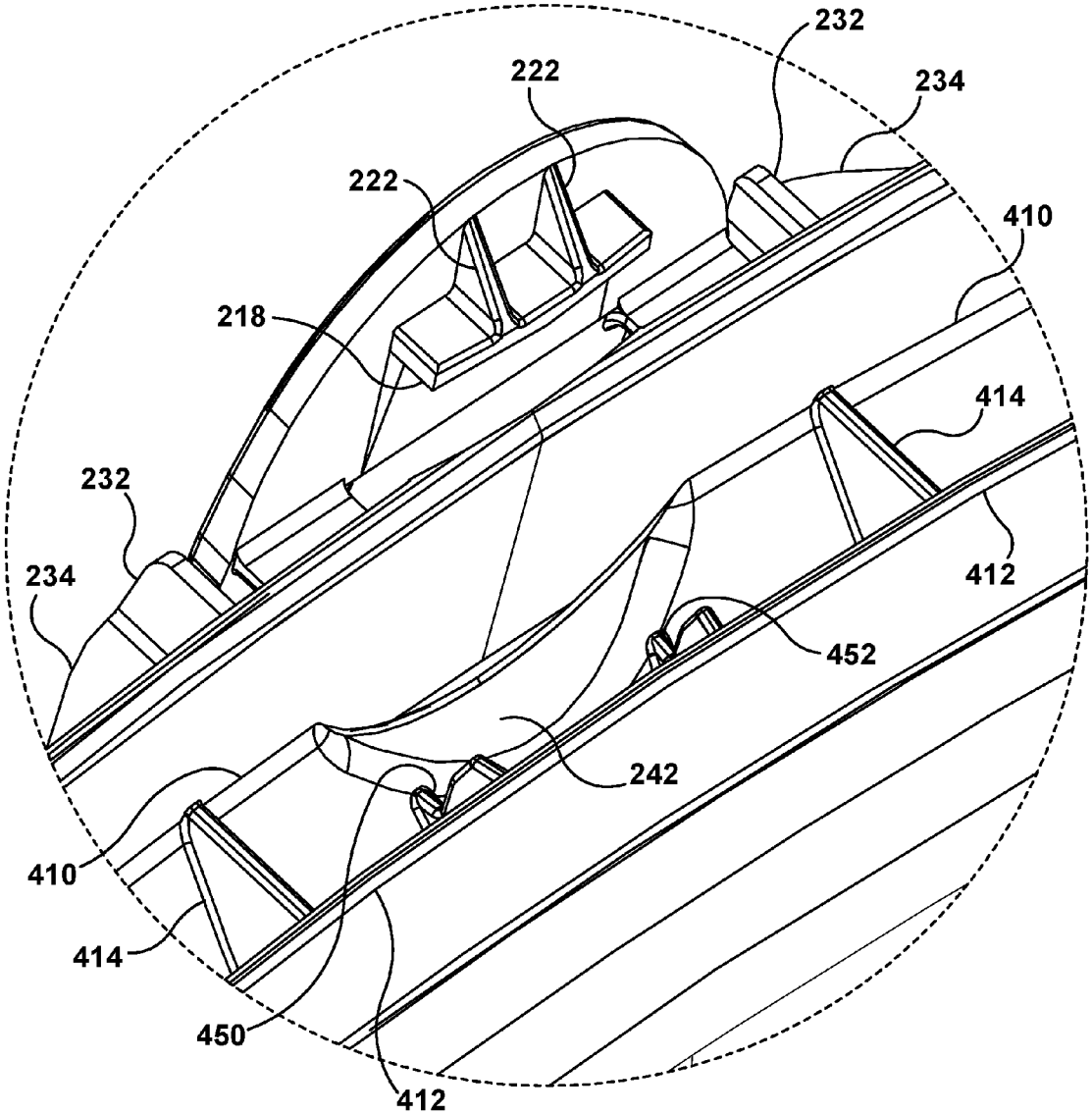
FIG. 10 is an enlarged perspective view of the designated circular area of FIG. 2.
Figure 11:
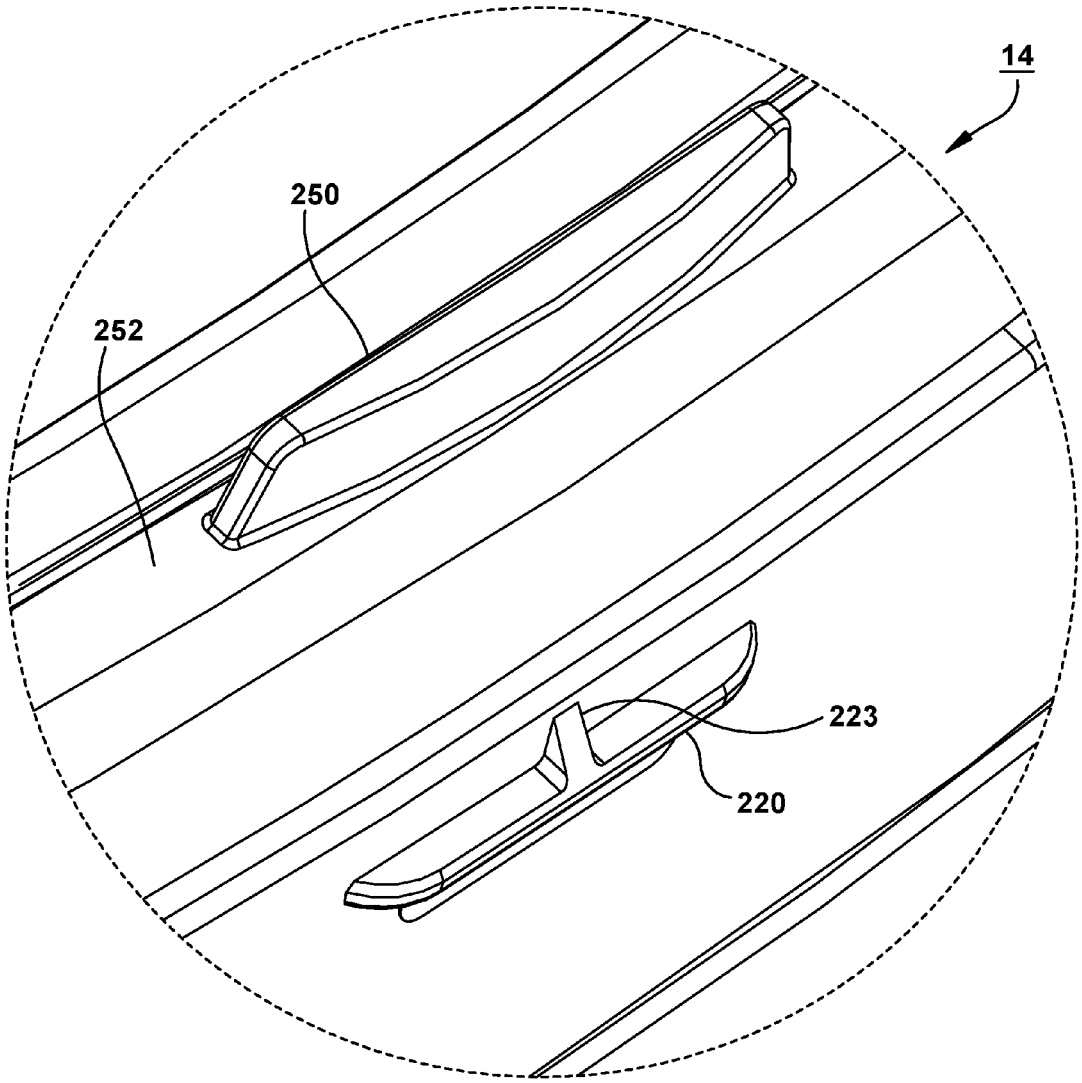
FIG. 11 is an enlarged perspective view of the designated circular area of FIG. 2.
Figure 12:
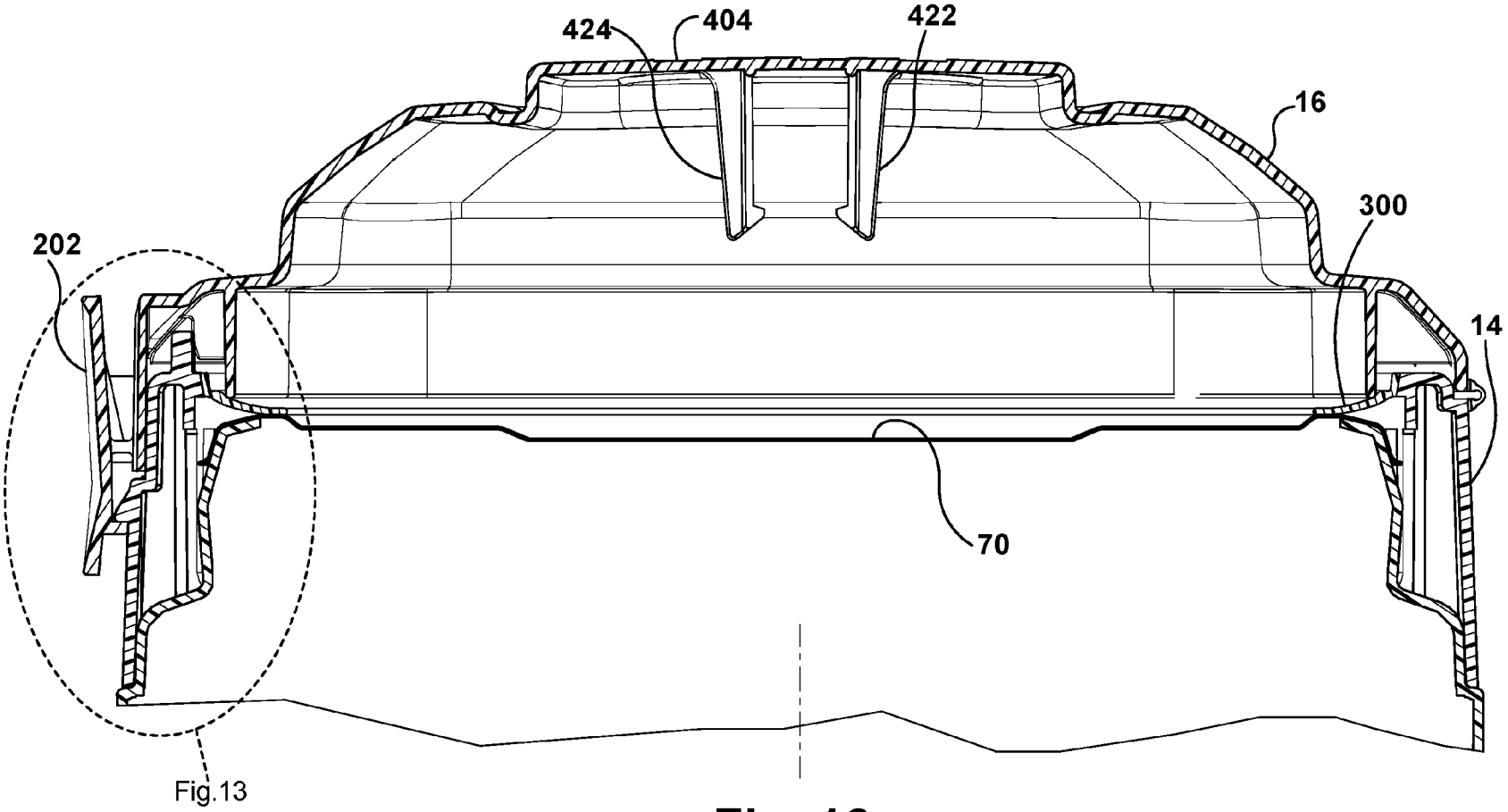
FIG. 12 is a sectional view of the container of FIG. 1.
Figure 14:
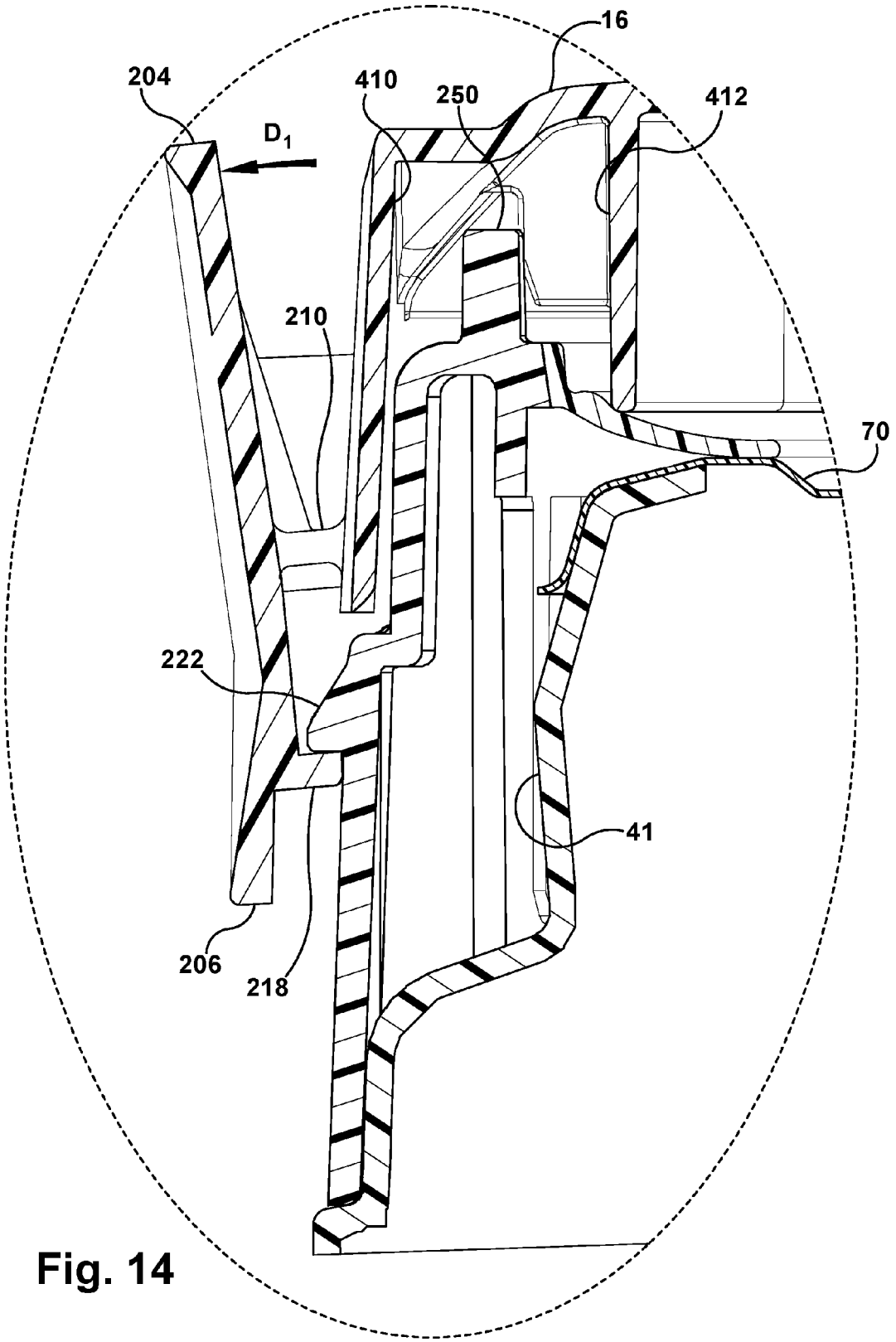
FIG. 14 is an enlarged perspective view of the designated circular area of FIG. 12, shown with a top portion of the actuator rotated away from the lid.

Referring now to the collar 14 and FIG. 11, an upwardly protruding flag 250 is positioned on a top surface 252 of the collar 14. The flag 250 is centered on the collar to engage the lid in a position between the interior wall 412 and exterior wall 410 of the lid 16, as shown in FIG. 14, for example. Specifically, the exemplary flag 250 nests into two receiving brackets 450, 452 (see FIGS. 8 and 10) which extend outward from the inner wall 412 of the lid 16. The configuration of the brackets 450, 452 and the flag 250 add reinforcement to the engagement of the lid and the collar, and allow the fingertip operation of the latch mechanism.

Figure 13:
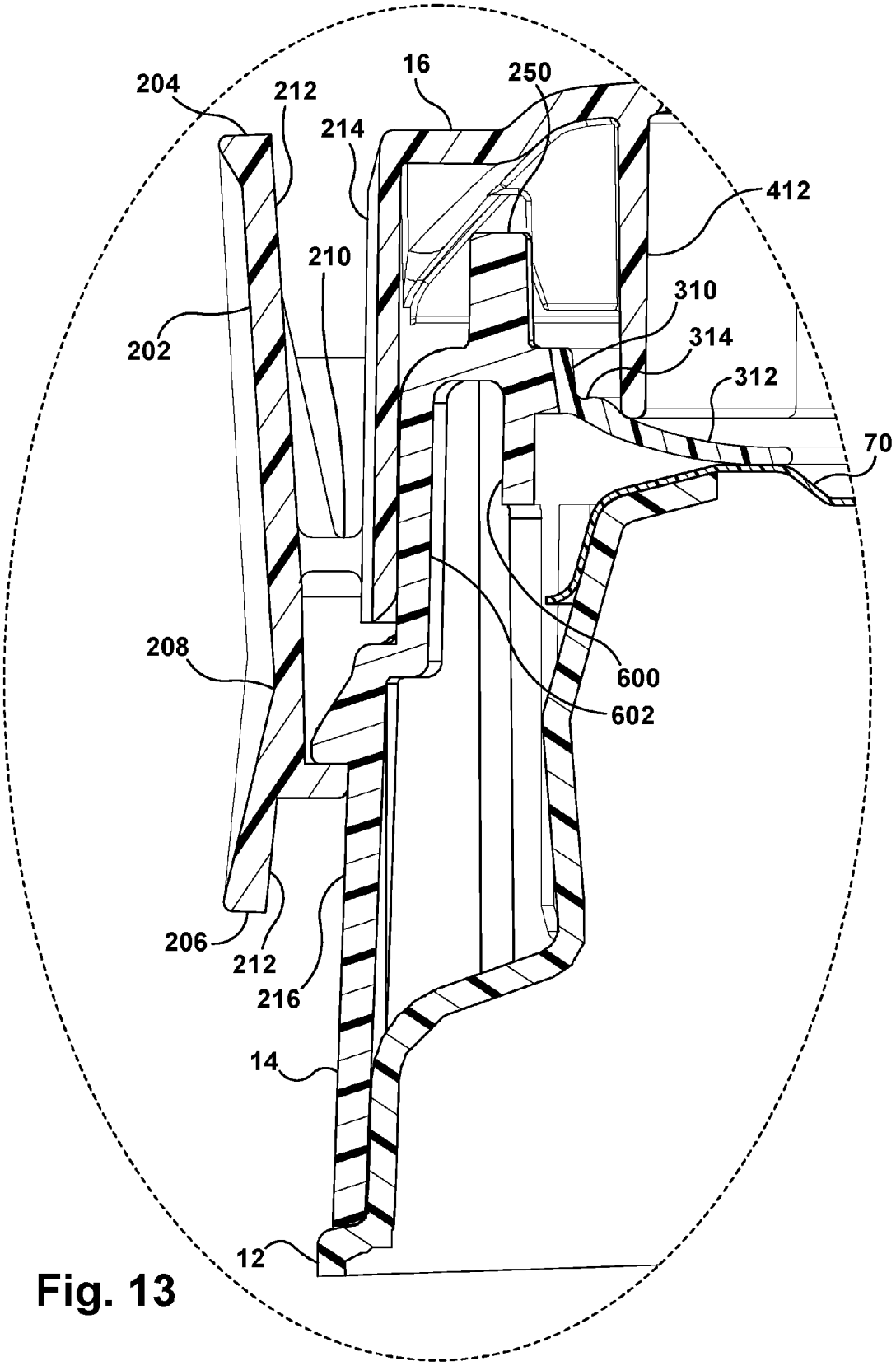
FIG. 13 is an enlarged perspective view of the designated circular area of FIG. 12, shown with an actuator in a secured position.

Still referring to the collar 14, a downwardly extending flag 600 can best been seen in FIG. 13. The flag 600 is positioned behind the inside surface 602 of the collar and essentially under the upwardly protruding flag 250. With the collar 16 attached to the receptacle 12, the flag 600 contacts a hemispherical-shaped protrusion 604 on an outer surface of the front side of the receptacle 12 (see FIG. 4). A similarly shaped protrusion 606 is shown on the back side of the receptacle in FIGS. 17 and 18. The contact of the flag 600 with the protrusion 604 adds to the reinforcement of the collar 14 and the receptacle 12, as well the reinforcement of the collar 14 and the lid 16.

Figure 6:
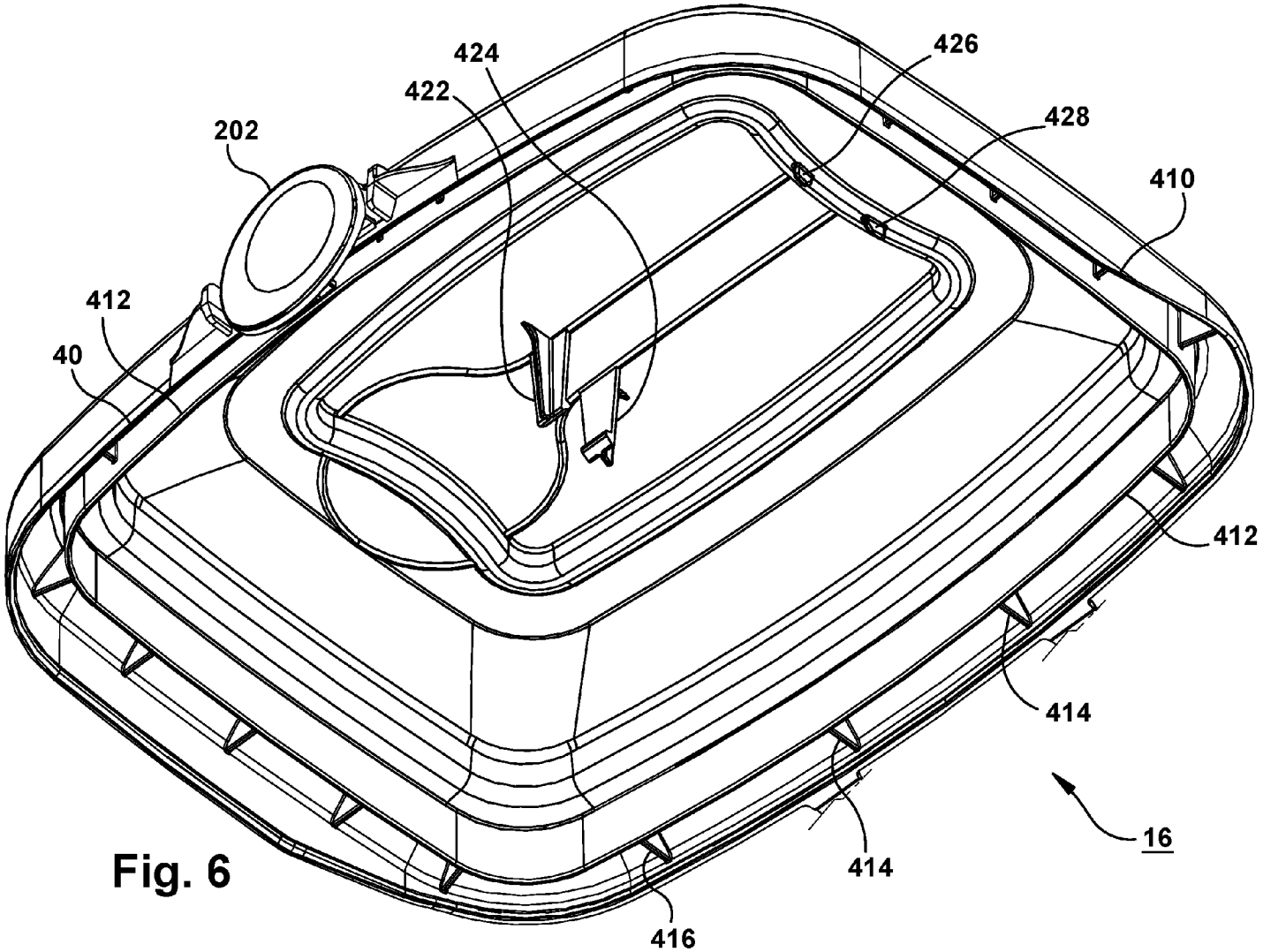
FIG. 6 is a bottom perspective view of the lid of FIG. 1.

The structure of the lid 16 adds to the overall stability and strength of the container 10. To emphasize certain structural features, a bottom perspective view of the lid 16 is shown in FIG. 6 without the collar 14. The lid has an exterior wall 410 and an interior wall 412. Each wall 410, 412 vertically descends in a direction toward the collar 14 when in the closed position, such as for example, as shown in FIG. 16. In the exemplary lid 16, the walls 410, 412 are parallel, and the exterior wall 410 extends downward to a position below the interior wall 412. As seen in FIGS. 6, 8, and 10, for example, a plurality of bridges 414 extend between the walls 410, 412 to add stability to the lid during engagement with and disengagement from the collar.

The lid 16 offers storage for a scoop 420 when not in use. The scoop 420 is stored in between clips 422, 424, 426, 428 extending from the bottom side of the lid 16. A scoop 420 is shown in FIG. 5 for example, but for clarity the scoop is not included in other figures. The clips 422, 424, 426, 428 are positioned to secure the handle 430 of the scoop only, allowing for a scoop having a bowl 432 of varying shape, size and volume. The clips 422, 424, 426, 428 are for example only, and the invention may be practiced with clips of other location, size, shape and quantity.

The container includes a latch for manipulation of the lid from an engaged position relative the collar to an unengaged position relative the collar. The actuator provides a user with precise fingertip control of the latch, without requiring the user to engage or contact the surface of the lid or collar. Many conventional collar and lid latch mechanism require a user to brace one or more fingers against the lid or the collar when opening the lid. However, the stability and strength afforded by the assembly of the inventive receptacle, collar, and lid, allows for ease of operation of the latch.

Relying upon fingertip movement of a single part of the latch, a user can move the lid between engaged and unengaged positions relative the collar. The latch includes an actuator rotatable in two directions relative to the lid and detachably engaged to a catch. In the exemplary embodiment on FIGS. 9-11 and 13-15, for example, the actuator is located on a front face of the lid and the catch protrudes from an outside surface of the collar.

Figure 9:
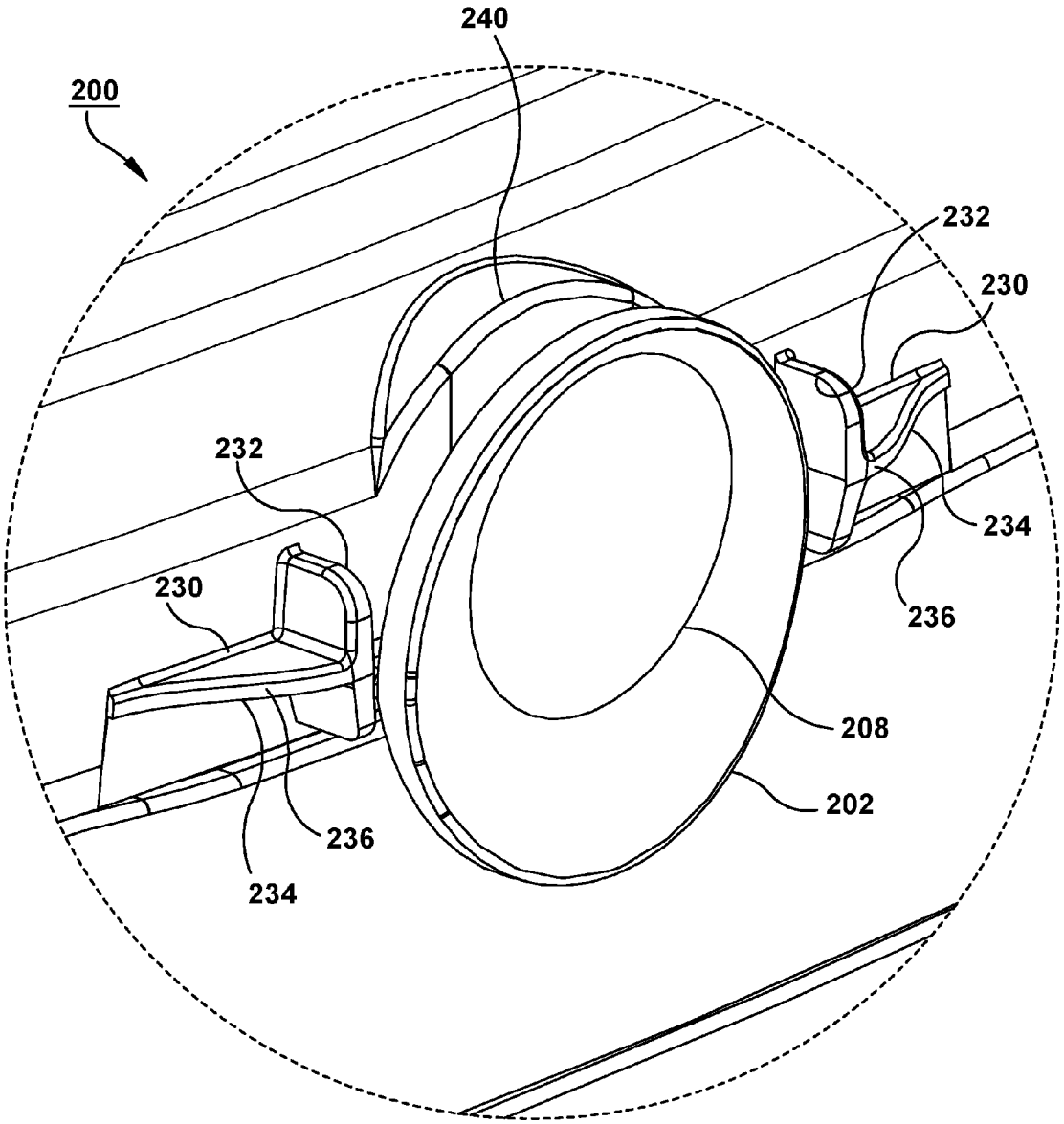
FIG. 9 is an enlarged perspective view of the designated circular area of FIG. 1.

An enlarged front perspective view of the latch 200 is shown in FIG. 9, showing the enlarged perspective view of the designated circular area of FIG. 1. The actuator 202 is rotatable relative to a horizontal axis of the container 10. The actuator is generally coin shaped, i.e., has a circle-shaped face and a thickness which offers an easily gripped top portion 204 and bottom portion 206. Of course, a user may make contact with the actuator 202 at any point or points in the manipulation of the actuator, such as for example, by using one or more fingers within a concave front face 208. It should be understood that the illustrated actuator 202 is for example only, and that actuators of other shape and size may be used is the practice of this invention.

The actuator is adapted to attach to a catch on the outside surface of the container. The adapter includes a tooth 218 which protrudes from an inside surface of the actuator 202, as best shown in FIG. 10. The tooth 218 is braced on a bottom surface by two supports 222. When the actuator engages the bottom surface of the catch 220, as shown in FIG. 13, the supports prohibit downward movement on the tooth 218. Similarly, the catch is supported on a top surface with a support 223, as shown in FIG. 11. When the actuator 202 engages the bottom surface of the catch 220, as shown in FIG. 13, the support 223 prohibits upward movement of the catch 220. It is believed the movement of the tooth 218 in a downward direction beyond the catch 220 produces an audible engagement, giving notice to the user that the lid 16 is secure in a closed position.

The actuator offers precise finger tip control for the user. For example, the actuator can be rotated in two directions relative the container. As discussed herein, a top portion of the latch can be rotated away toward the lid. When the lid is moved to an open position and released, the actuator is biased to passively return to an at rest position, as shown on FIG. 13. If a user does not move the lid to an open position after rotated the actuator toward the lid, and merely releases the actuator, the actuator is biased to passively return to an at rest position, as shown on FIG. 13. The lid can be opened with the user only operating the actuator with his fingertips.

The actuator 202 includes several structural features which promote rotation by a user. Two bridges 210 extend from the front face 214 of the lid 16 to support the actuator 202. As such, the inside surface 212 of the actuator 202 in the closed position, as shown in FIG. 13, is remotely disposed from each of an outside surface 214 of the lid 16 and an outside surface 216 of the collar 14. This configuration permits the top portion 204 of the actuator to be rotated in two directions relative to the container. For example, the top portion 204 of the actuator 202 has been rotated a direction $D_1$ from the lid 16 in FIG. 14. In this position, the tooth 218 is still engaged with the catch 220. However in FIG. 15, the top portion 204 has been rotated a direction $D_2$ toward the lid. As such, the bottom portion 206 of the actuator has disengaged from the catch 220. Further movement of the actuator in an upward direction $D_3$ will move the lid to an open position. Alternatively, a user may rotate a bottom portion of the actuator in a direction away from the lid to disengage the actuator from the catch.

Referring again to FIG. 9, other structural benefits of the latch assembly are shown. Mounted in an extended position away from the outside surface of the container, the actuator is susceptible to damage. For example, the actuator could be inadvertently hit on the production line, in shipping, or in the kitchen or bathroom during use by the consumer. A lateral force may damage the actuator and otherwise compromise the precise operation of the latch mechanism. To prohibit such damage, the actuator is protected on either side by a bumper.

As seen in FIG. 9, the lid 16 includes a bumper 230 located on either side of the actuator 202. Each bumper 230 protrudes outward from an outer surface of the lid 16. The T-shaped bumper includes a horizontal brace 234 supporting a vertical wall 232 adjacent the actuator 202. Each horizontal brace 234 has an outer surface 236 ramping away from the lid in a direction toward the actuator 202 (also see FIG. 5, for example). The outer surface 236 is configured to deflect lateral moving objects, relative to the position of the container, out and away from the actuator. The shape of the horizontal brace 234, and the general positioning of the bumper, prohibits damage to the actuator. It should be understood that the illustrated bumpers 320 are for example only, and that bumpers of other shape, size and quantity may be used is the practice of this invention.

Figure 15:
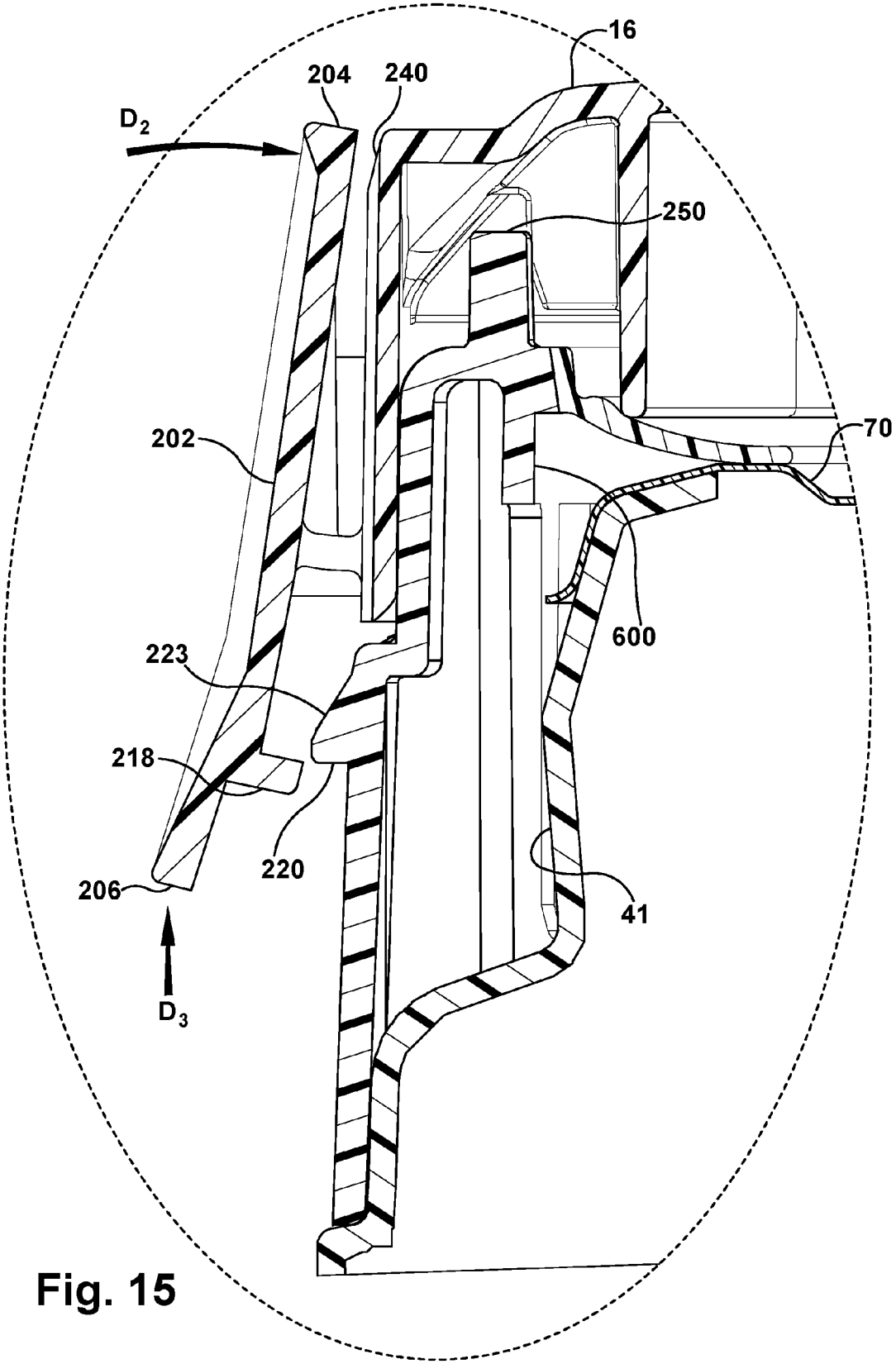
FIG. 15 is an enlarged perspective view of the designated circular area of FIG. 12, shown with a top portion of the actuator in an unsecured position.

The lid 16 also includes structure to limit movement of the actuator. Referring again to FIG. 9, a engagement block 240 is positioned on the lid. The inside concave surface 242 of the engagement block is illustrated in FIG. 10. The engagement block is cooperatively shaped relative the actuator and positioned to limit a rotation of a top portion 204 of the actuator in a direction toward the lid. For example, FIG. 15 illustrates the actuator in a position just prior to contact between the top portion 204 of the actuator 202 and the engagement block 240. In this configuration, rotation of the actuator is limited in one direction, and when contact is made with the engagement block, a user is clued that further rotation is not required and the lid may be moved to the open position. It should be understood that the illustrated engagement block 240 is for example only, and that blocks of other shape, size and quantity may be used is the practice of this invention.

Figure 24:
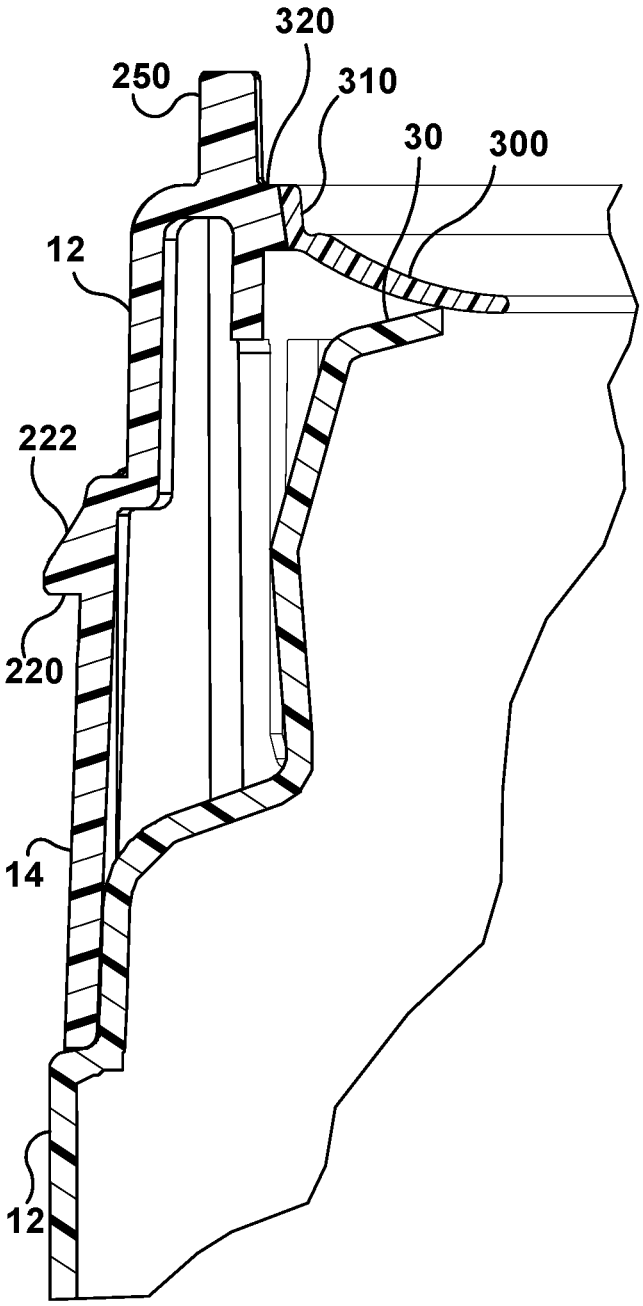
FIG. 24 is an enlarged sectional view of a portion of the container of FIG. 1, shown with a lid of the container in an open position and the seal removed.
Figure 25:
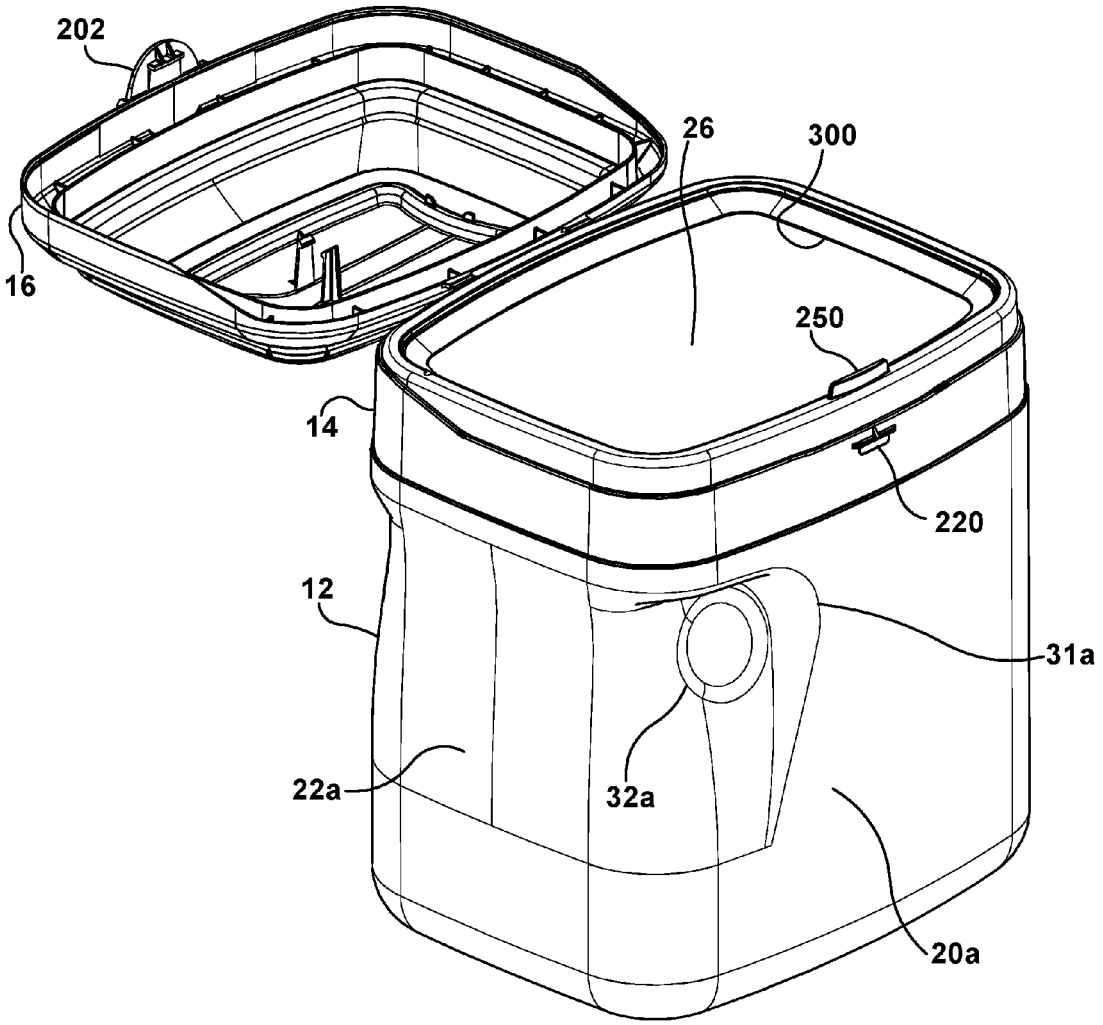
FIG. 25 is a front perspective view of the container of FIG. 1, shown with a lid of the container in an open position and the seal removed.

In one embodiment of the invention, the container includes a flexible gasket. The flexible gasket is affixed to an inside wall of the collar and is dimensioned to project inwardly to removably rest against the sealing flange 30 of the receptacle 12, as depicted in FIGS. 13-16, for example, with the lid in the closed position. The flexible gasket 300 projects slightly downwardly to be biased against the sealing flange 30 for an improved sealing configuration. The flexible gasket 300 remains biased against the sealing flange 30 with the lid in the opened position, as shown in FIG. 24. As shown in FIG. 13 with the seal in place and in FIG. 24 with the seal removed, the flexible gasket 300 extends interiorly to project beyond the internal edge 24 of the sealing flange 30. With the lid 16 closed, as in FIG. 13, the flexible gasket 300 is removably positioned between the inner wall 412 of the lid 16 and the sealing flange 30.

The flexible gasket 300 has several inventive features beneficial to the sealing performance of the container. As best seen in FIG. 13, the flexible gasket includes a vertical portion 310 separated from an inwardly protruding portion 312 by a trough 314. The vertical portion extends upward to an upper seat surface 252 around a circumference of the collar. The trough extends around the circumference of the flexible gasket 300. The trough reduces the resistance of the gasket during removal of the seal by providing a void into which the inward end of inwardly protruding portion 312 may bend. Further, the trough 314 is believed to provide a gathering location for relatively small amounts of moisture to gather in a location remote from the seal before it is removed, and a gather location remote from the powder after the seal is removed.

As discussed herein, a seal is used to protect the contents of the container after packaging, during shipment and during storage prior to sale. The sealing layer may help to preserve freshness or indicate tampering. Any suitable seal material may be selected, such as for example, a material suitable to protect the contents from moisture, oxygen and light. The sealing layer may include a tab that facilitates removal of the sealing layer by the end user. Any gasket used in the container is adhered directly to the collar during manufacturing, such that the gasket will not subsequently interfere during a seal removal process by the consumer. In the removal process, the lid will in the open position and the gasket will flex up and out of the way of the seal.

Referring now to FIG. 18, a receptacle is shown prior to assembly to the collar. In this illustrated stage of packaging, the receptacle contains a powdered product and a sealing layer has been attached to the top surface of the receptacle. The seal is constructed from a substantially moisture-impervious, oxygen-impervious material, such as for example, aluminum foil, or a foil made of some other metallic material, or a combination of a layer of materials that can include a metallic, a polymeric, and other material layers.

Figure 19:
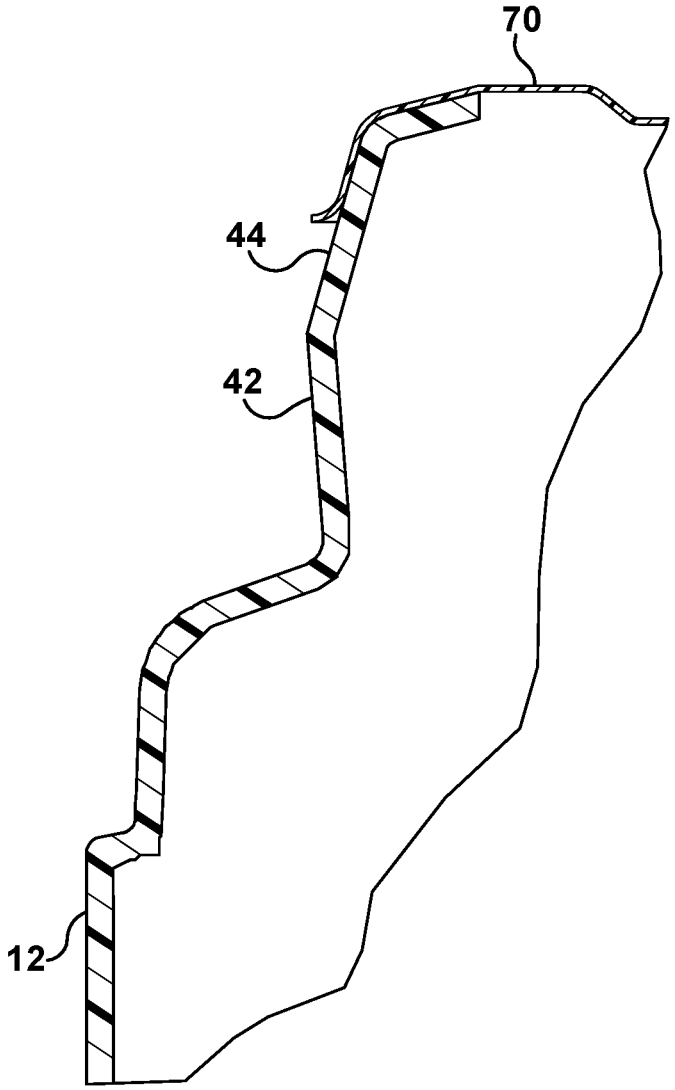
FIG. 19 is an enlarged view of a portion of the container of FIG. 1, shown with the lid and the collar of the container removed.

In the packaging process, the seal is attached to the outside surface of the receptacle. The seal is adhered to the receptacle by a pressing operation. As shown in FIG. 19, the seal extends downward the outer surface of the upper portion to a tapered surface 44. In the exemplary seal shown, an impression pattern has been left upon a top surface of the seal. Specifically, an inner depression pattern 73*a* compliments the shape of an outer depression 73*b* which borders the sealing flange of the receptacle. In the practice of this invention, alternative impression patterns may be left upon a top surface of the seal, or no impression pattern may be left upon a top surface of the seal.

Figure 21:
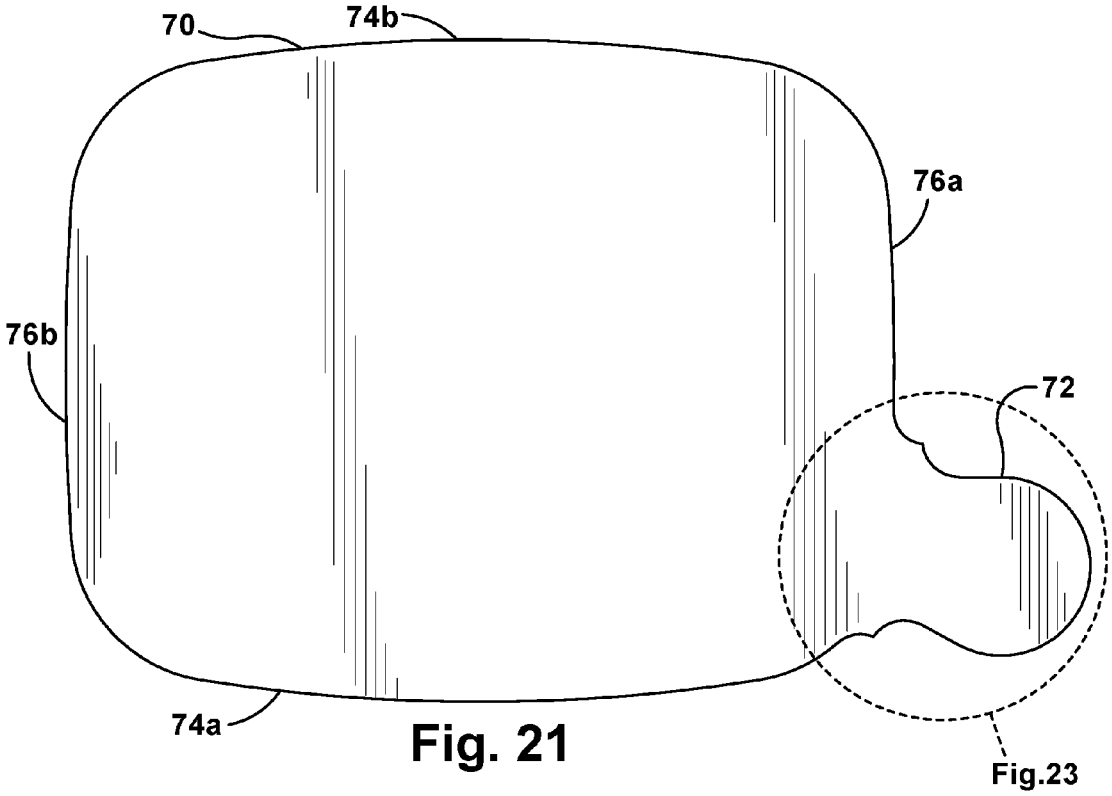
FIG. 21 is a top view of the seal of FIG. 18.

An exemplary seal 70 is illustrated in a top view in FIG. 21. The seal includes a tab 72 which extends from the container for grasping by the user. The shape of the seal is defined by two opposing and longer sides 74*a*, 74*b* and two opposing and shorter sides 76*a*, 76*b*. The tab 72 is disposed along a short side. In the exemplary seal illustrated, the tab 72 is disposed along the short side 76*a*.

When the seal 70 is attached to the receptacle 12, as shown in FIG. 18, the tab is disposed along the right side wall 22*a*. This seal location is for example only, and when practicing this embodiment of the invention, the seal could be located at other locations along the right side wall 22*a*, or at other locations along the left side wall 22*b*.

Figure 23:
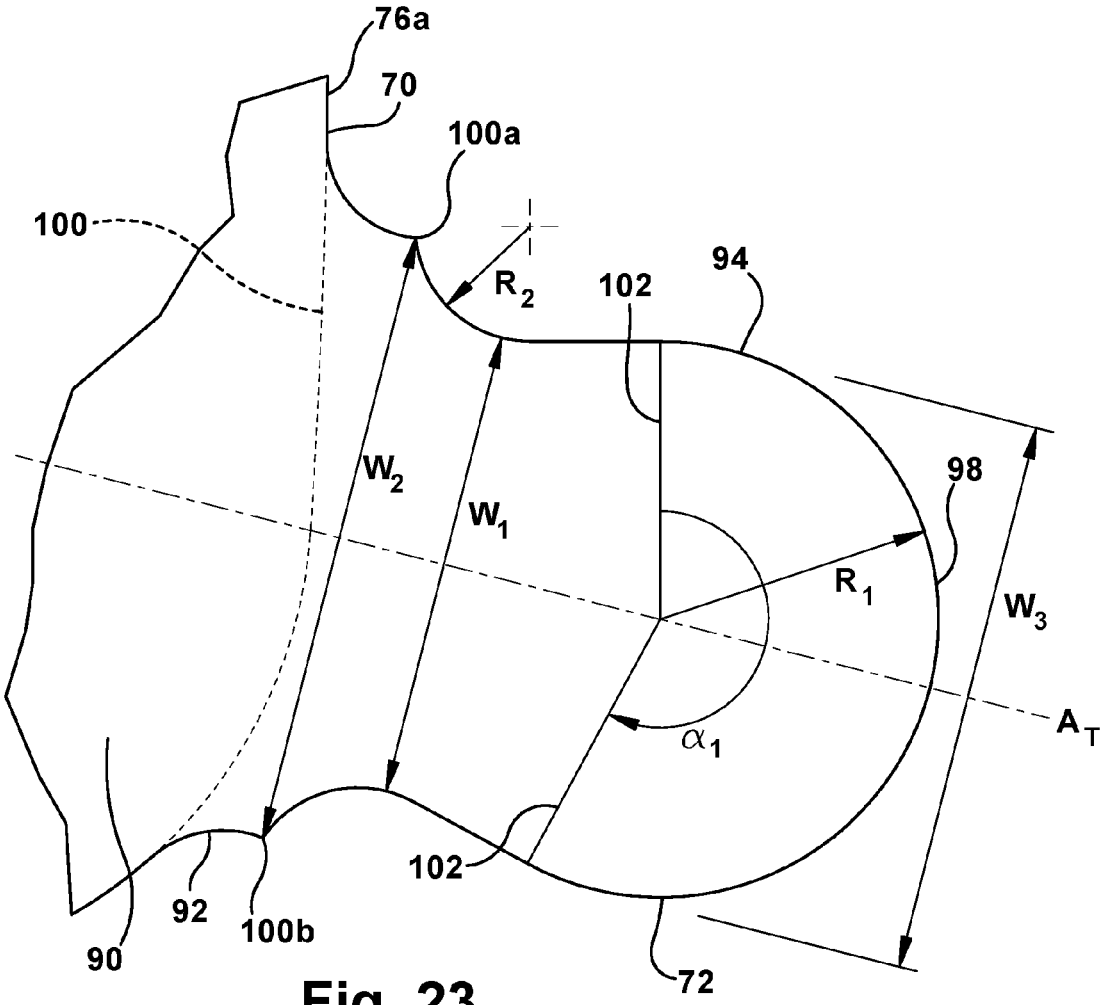
FIG. 23 is an enlarged top view of the designated circular area of FIG. 21.

The seal 70 has other inventive features beneficial to tear resistance during removal from the receptacle by a user. An enlarged top view of the designated circular area of FIG. 21 is shown in FIG. 23. The seal generally includes a covering portion 90, a tab portion 94, and a transition portion 92. The covering portion 90 extends over the sealing flange of the receptacle to seal the inner space. The transition portion 92 is disposed between the covering portion and the gripping portion and includes several inventive features which reduce tearing during removal of the seal. The transition portion 92 illustrated in FIG. 23 generally extends from the covering portion, i.e., about from the end line 100 of the seal which contacts the receptacle, to the boundary line 102 of the tab having a constant radius $R_1$. As shown, the constant radius $R_1$ of the distal end 98 of the tab 72 is an angle $\alpha_1$, which as illustrated, is greater than 180 degrees. An angle of over 180 degrees allows certain features, such as for example, the tab 72 has no planar edge surfaces. This illustrative angle is for example only, and in the practice of this embodiment of the invention, other angles of over 180 degrees may be used.

The tab 72 illustrated in FIGS. 21 and 23 have other inventive features which reduce tearing of the seal during removal from the receptacle by the user. The width of the tab 72 reduces between the transition portion 92 and gripping portion 94. The sinusoidal shape of the outside edge of the tab 72 is exaggerated by the width changes of the tab from the covering portion 90 to the distal end 98 of the tab. Specifically, the width changes from the two opposing points 100*a*, 100*b* at a maximum width $W_1$ of the transition portion, to a minimum width $W_2$, then expanding again to a width $W_3$, equal to the diameter of the gripping potion 94. The width in fact constantly changes from one end of the tab to another, such that the tab 72 has no planar edge surfaces.

Figure 22:
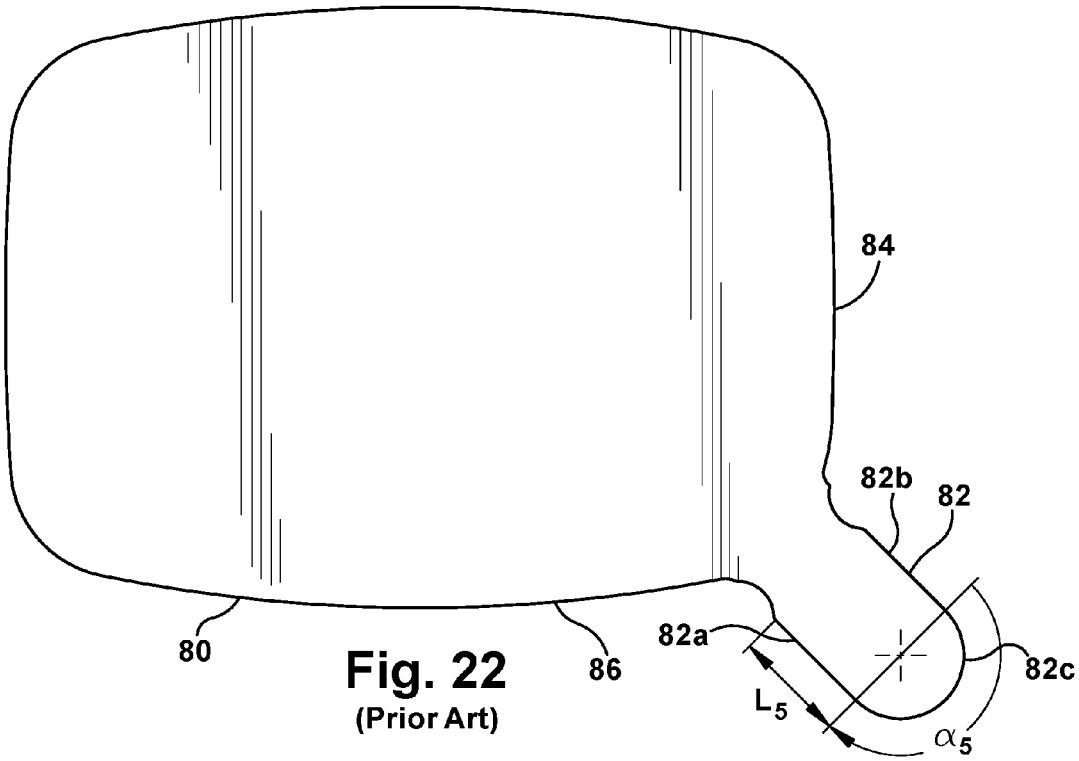
Fig. 22 (Prior Art)
FIG. 22 is a top view of an exemplary seal of the prior art.

For reference, a prior art seal is shown in FIG. 22. The seal 80 includes a tab 82 located at a corner between a short side 84 and a long side 86. A seal of this shape and location is susceptible to inadvertent and undesirable tearing by the user during removal of the seal. Tearing of the seal may delay access to the powder by the end user, and may result in spilling of the powder if and when the end user seeks offer methods for accessing the powder. The illustrated tab 82 is defined by two straight and parallel sides 82*a*, 82*b*, each side having the same length $L_5$. A distal end 82*c* of the tab 82 has a constant radius over an angle $\alpha_5$, which as illustrated, is not more than 180 degrees.

The inventive shape of the tab 72 offers dramatic improvement in tearing resistance over conventional tabs. In fact, testing of the inventive tab shape resulted in unexpected performance. In tear resistance testing, the tab shape of FIGS. 21 and 23 significantly outperformed the tab shape of FIG. 22. In testing, a positive tearing test results from a user tearing any portion of the foil seal during a removal attempt. For reference, the tab shape 80 exhibited tearing at some point during removal at a rate of 90%. In other words, only 10% of seals having the tab shape 80 could be entirely removed from the receptacle without some tearing. Testing of the inventive tab resulting in tearing at a rate of only 10%. Specifically, at least 70% of seals having the tab 72 with the inventive shape were removed or peeled 50% of the way of the receptacle without tearing. At least 30% of the seals having the tab 72 with the inventive shape were removed or peeled 100% of the way of the receptacle without tearing. One reason believed for the dramatic increase of tear resistance is the shape of the invention tab is believed to not promote any tear propagation point along the outside edge of the tab, as compared to known tab shapes in the art. Another reason believed for the dramatic increase of tear resistance is the reduction of force required to remove the seal in the inventive container as compared to known containers, in part due to the inventive gasket shape, such as for example, the trough in the gasket.

While various inventive aspects, concepts and features of the general inventive concepts are described and illustrated herein in the context of various exemplary embodiments, these various aspects, concepts and features may be used in many alternative embodiments, either individually or in various combinations and sub-combinations thereof. Unless expressly excluded herein all such combinations and sub-combinations are intended to be within the scope of the general inventive concepts. Still further, while various alternative embodiments as to the various aspects, concepts and features of the inventions (such as alternative materials, structures, configurations, methods, circuits, devices and components, alternatives as to form, fit and function, and so on) may be described herein, such descriptions are not intended to be a complete or exhaustive list of available alternative embodiments, whether presently known or later developed. Those skilled in the art may readily adopt one or more of the inventive aspects, concepts or features into additional embodiments and uses within the scope of the general inventive concepts even if such embodiments are not expressly disclosed herein. Additionally, even though some features, concepts or aspects of the inventions may be described herein as being a preferred arrangement or method, such description is not intended to suggest that such feature is required or necessary unless expressly so stated. Still further, exemplary or representative values and ranges may be included to assist in understanding the present disclosure; however, such values and ranges are not to be construed in a limiting sense and are intended to be critical values or ranges only if so expressly stated. Moreover, while various aspects, features and concepts may be expressly identified herein as being inventive or forming part of an invention, such identification is not intended to be exclusive, but rather there may be inventive aspects, concepts and features that are fully described herein without being expressly identified as such or as part of a specific invention. Descriptions of exemplary methods or processes are not limited to inclusion of all steps as being required in all cases, nor is the order that the steps are presented to be construed as required or necessary unless expressly so stated.

What is claimed is:

1. A container comprising:

walls defining an interior space and an upper portion, the upper portion defining a sealing flange having an internal edge which defines an opening to the interior space;

a collar attached to the upper portion;

a lid attached to the collar for positioning between an open position and a closed position, and adapted to cover the opening while in the closed position; and a latch attached to an outer surface of the lid, the latch having an actuator rotatable in two directions relative to the lid and detachably engaged to a catch, the catch protruding from an outside surface of the collar; and wherein the actuator has a top portion, a bottom portion, and an inside surface, wherein the actuator is attached to an outer surface of the lid by one or more bridges that extend outward from the outer surface of the lid to the inside surface of the actuator at a location between the top portion and the bottom portion, and wherein the inside surface of the actuator in the closed position is remotely disposed from each of the outer surface of the lid and the outside surface of the collar.

2. The container of claim 1, wherein collar further comprises an upwardly protruding flag, the flag positioned to nest between two receiving brackets on the lid with the lid in the closed position.

3. The container of claim 1, wherein collar further comprises a downwardly protruding flag, the flag positioned to contact a protrusion on an outer surface of the upper portion.

4. The container of claim 3, wherein the protrusion is hemispherical-shaped.

5. The container of claim 3, wherein the downwardly protruding flag is positioned essentially under an upwardly protruding flag on the collar.

6. The container of claim 1, wherein a tooth protrudes from an inside surface of the actuator.

7. The container of claim 6, wherein the inside surface of the actuator extends from top portion of the actuator to below the tooth.

8. The container of claim 6, further comprising one or more supports on a bottom surface of the tooth.

9. The container of claim 1, further comprising one or more supports on a top surface of the catch.

10. The container of claim 1, wherein the actuator is disk-shaped.

11. The container of claim 1, wherein a rotation of top portion of the actuator in a direction toward the lid combined with upward lifting of bottom portion of the actuator disengages the actuator from the catch.

12. The container of claim 1, wherein top portion of the actuator in the closed position is rotatable in either direction relative the lid.

13. The container of claim 1, wherein one or more bridges connect to the latch near a mid-point between the upper portion and the lower portion.

14. A container comprising:

walls defining an interior space and an upper portion, the upper portion defining a sealing flange having an internal edge which defines an opening to the interior space;

a collar attached to the upper portion;

a lid attached to the collar for positioning between an open position and a closed position, and adapted to cover the opening while in the closed position; and a latch attached to an outer surface of the lid, the latch having an actuator rotatable in two directions relative to the lid and detachably engaged to a catch, the catch protruding from an outside surface of the collar, wherein an inside surface of the actuator in the closed position is remotely disposed from each of the outer surface of the lid and the outside surface of the collar, and wherein the lid further comprises an exterior wall, an interior wall parallel to the exterior wall, and a plurality of bridges extending between the exterior wall and the interior wall.

15. The container of claim 14, wherein the exterior wall extends downward to a position below the interior wall when the lid is in the closed position.

16. The container of claim 14, wherein the lid further comprises a bumper on either side of the actuator, each bumper protruding outward from an outer surface of the lid.

17. The container of claim 14, further comprising one or more supports on a top surface of the catch.

18. A container comprising:

walls defining an interior space and an upper portion, the upper portion defining a sealing flange having an internal edge which defines an opening to the interior space;

a collar attached to the upper portion;

a lid attached to the collar for positioning between an open position and a closed position, and adapted to cover the opening while in the closed position; and a latch attached to an outer surface of the lid, the latch having an actuator rotatable in two directions relative to the lid and detachably engaged to a catch, the catch protruding from an outside surface of the collar, wherein an inside surface of the actuator in the closed position is remotely disposed from each of the outer surface of the lid and the outside surface of the collar, and wherein the lid further comprises a bumper on either side of the actuator, each bumper protruding outward from an outer surface of the lid.

19. The container of claim 18, further comprising one or more supports on a top surface of the catch.

20. The container of claim 18, wherein the actuator has a top portion, a bottom portion, and an inside surface, and wherein the actuator is attached to an outer surface of the lid by one or more bridges that extend outward from the outer surface of the lid to the inside surface of the actuator at a location between the top portion and the bottom portion.

* * * * *